US006227467B1

(12) United States Patent
Davenport

(10) Patent No.: US 6,227,467 B1
(45) Date of Patent: May 8, 2001

(54) FUELS BLENDING SYSTEM

(76) Inventor: Ricky W. Davenport, 814 Omega Dr., Lafayette, LA (US) 70506

( * ) Notice: Subject to any disclaimer, the term of this patent is extended or adjusted under 35 U.S.C. 154(b) by 0 days.

(21) Appl. No.: 08/802,848

(22) Filed: Feb. 19, 1997

Related U.S. Application Data

(63) Continuation of application No. 08/477,229, filed on Jun. 7, 1995, now abandoned.

(51) Int. Cl.[7] ..... B02C 7/00; B02C 7/02

(52) U.S. Cl. ..... 241/15; 241/16; 241/21; 241/27; 241/261.3

(58) Field of Search ..... 241/261.2, 261.3, 241/297, 298, 300, 15, 16, 20, 21, 27, 29

(56) References Cited

U.S. PATENT DOCUMENTS

| | | | | |
|---|---|---|---|---|
| 992,000 | * | 5/1911 | Kihlgren | 241/261.2 |
| 1,666,640 | * | 4/1928 | Cunniff | 241/261.2 X |
| 2,988,290 | * | 6/1961 | Merges | 241/296 X |
| 3,523,649 | * | 8/1970 | Laakso | 241/297 X |
| 3,910,511 | * | 10/1975 | Leider et al. | 241/261.3 |
| 4,767,065 | * | 8/1988 | Wray | 241/261.3 X |
| 5,042,726 | * | 8/1991 | Reinhall | 241/28 |
| 5,244,159 | * | 9/1993 | Newnan | 241/261.3 |
| 5,248,099 | * | 9/1993 | Lahner et al. | 241/28 |
| 5,383,617 | * | 1/1995 | Deuchars | 241/298 |
| 5,495,986 | * | 3/1996 | Davenport | 241/21 |
| 5,564,634 | * | 10/1996 | Rouse et al. | 241/37 |
| 5,586,729 | * | 12/1996 | Davenport | 241/21 |

FOREIGN PATENT DOCUMENTS

326110 * 9/1920 (DE) ..... 241/261.3

* cited by examiner

*Primary Examiner*—John M. Husar

(57) ABSTRACT

A system for producing a suitable fuel from waste material including a dispersion tank in which a rotating impeller is positioned in the bottom of such tank in close spaced relationship above a stationary plate and the facing surfaces of the impeller and the plate include shear blocks which intermesh to grind solid materials in the tank and disperse the solid materials in a blend stock making a suitable fuel. A cylinder is connected to raise and lower the impeller to control the spacing between the impeller and the plate and thus control the spacing between the shear blocks to control the fineness of the grinding of the waste material. Means is provided for discharging metal from the dispersion tank and means is provided for circulating liquid from the dispersion tank to an accumulation tank and for recirculating the liquid from the accumulation tank to the dispersion tank. Feeding systems are provided for delivering solid waste material to the dispersion tank and include systems for grinding drums containing waste material, expressing waste material from the drums and augering waste material from the drums. The present invention also provide a method of is processing waste material and a blend stock which provides a suitable fuel and includes the steps of grinding the waste material in a tank containing the blend stock with the grinding being in at least part provided by the coaction between a rotating impeller and a stationary plate so that the degree to which the waste material is ground is controlled by controlling the spacing between the plate and the impeller.

21 Claims, 22 Drawing Sheets

FIG. 19
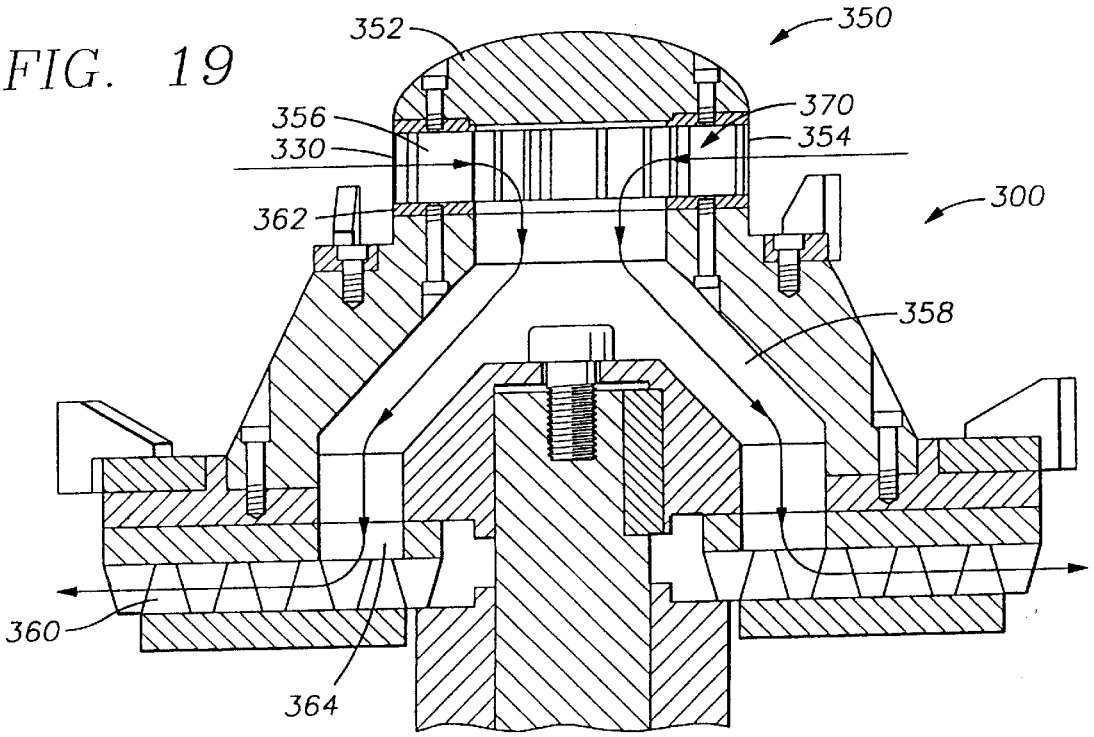
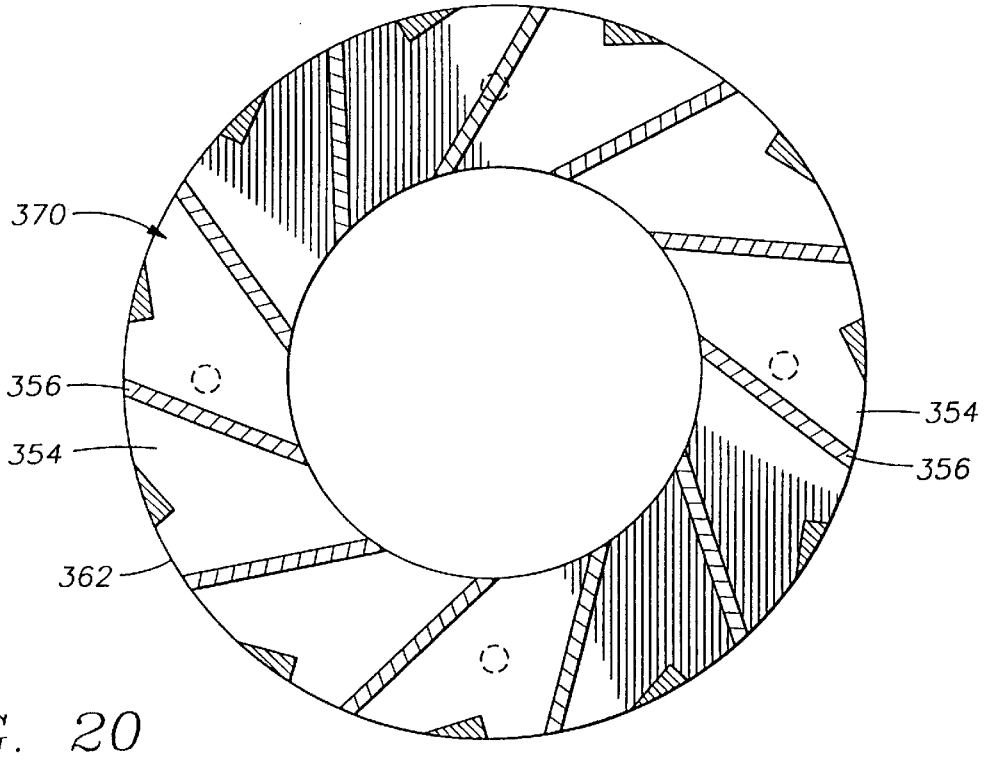
FIG. 20

FIG. 22
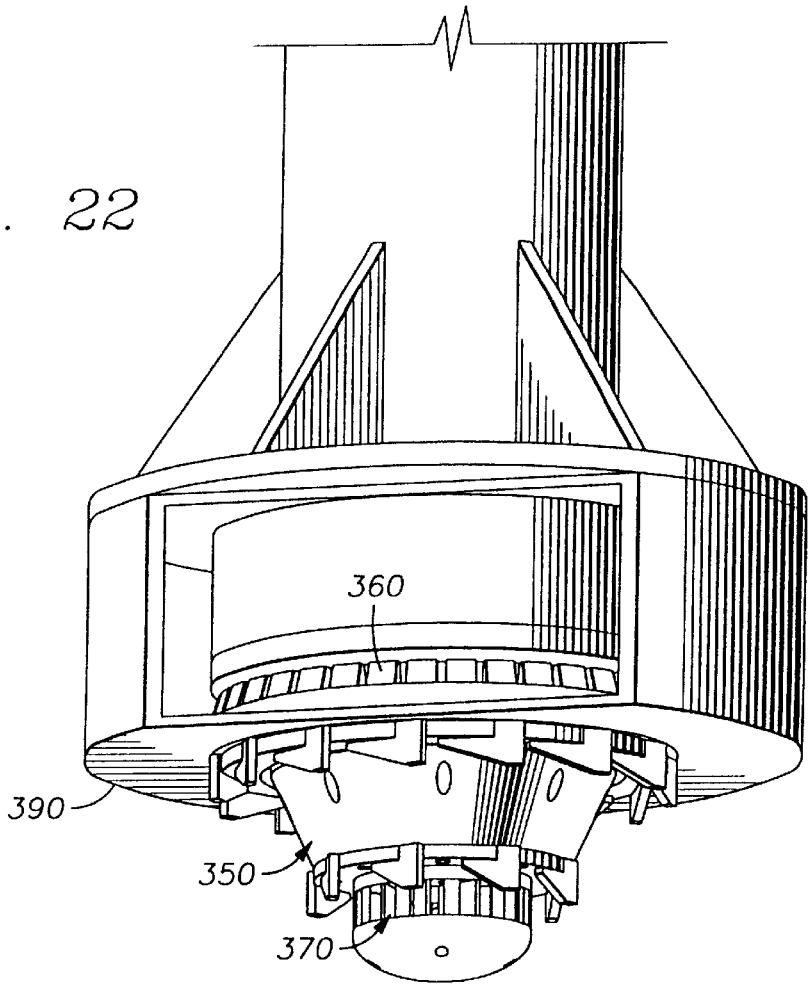
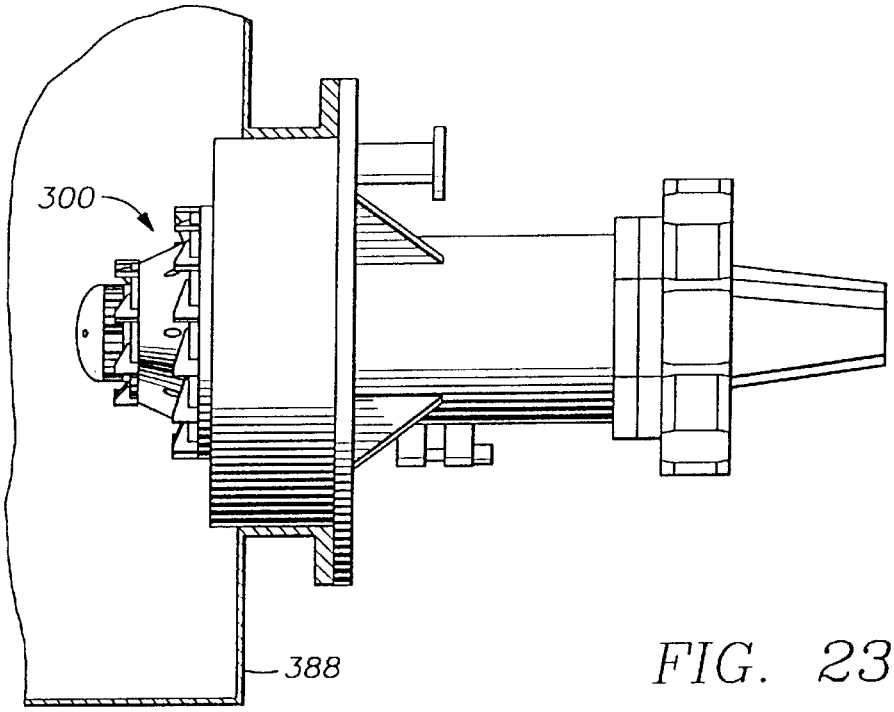
FIG. 23

FUELS BLENDING SYSTEM

APPLICATION FOR PATENT

This application is a continuation of application Ser. No. 08/477,229, filed Jun. 7, 1995, now abandoned.

BACKGROUND OF THE INVENTION

1. Field of the Invention

The present invention relates to an improved method and apparatus for the blending of fuel and hazardous chemical solid waste into a pumpable fuel which can be burned in conventional kilns, such as cement kilns, and in industrial furnaces designed for burning liquids. The present invention also provides an improved method and apparatus for the reduction in size of solids, such as tires, and the dispersion of such solids in a blend stock so that it can be readily used as a fuel which obtains heat from the solids and destroys the solid wastes so that they are no longer hazardous.

2. General Background

Cement kilns have been used to utilize waste materials to supply heat thereto and they function to destroy the liquefied hazardous waste. Cement kilns function as excellent incinerators because they have operating temperatures which exceed 1800° F. and the flame temperature of the primary burner exceeds 3000° F. The residence time of combustion gases inside the kiln far exceed the required two seconds specified by the EPA. Also, the large mass of reactive minerals traveling down the length of the kiln chemically binds with inorganics to provide a stabilizing effect and the turbulent flow of alkaline mineral dust within the combustion gases flowing down the kiln provides excellent scrubbing of the gases before they are discharged to the environment.

In my co-pending application Ser. No. 07/841,834, flied Feb. 25, 1992, now U.S. Pat. No. 5,257,586 there is disclosed an improved method and apparatus for feeding solid waste materials to the interior of a cement kiln which has unique systems for the prevention of back-flashing of combustion in the feeding system and a system for delivering the solids to the interior of the rotating drum without interfering with the drum rotation.

Prior to the present invention, a mixture of liquid and semi-liquid (sludge) waste material has been delivered to the burner of a kiln as a means of destroying the hazardous waste and obtaining usable heat from such destructive burning. Other efforts have been made to supply such wastes pneumatically as dry and powdered solids into the primary burner of a kiln. These methods greatly limit the types and amounts of solid hazardous wastes which have been burned in kiln burners and industrial furnaces.

SUMMARY OF THE INVENTION

The present invention provides an improved method and apparatus for processing hazardous waste solids and combining such waste solids with a suitable liquid blend stock so the solids are dispersed sufficiently to provide a fluid stream which is readily burnable in a kiln or industrial furnaces. The method involves the feeding of a suitable liquid blend stock to a dispersion tank together with partially reduced solid wastes and therein further reducing the solid wastes to a sufficiently small size and dispersing the wastes in the liquid stock and delivering the resultant stream to an accumulation tank from which the liquid dispersion may be withdrawn and delivered to a preselected burner for the destruction of the dispersed waste solids and for the generation of usable heat from the burning of such liquid dispersion. In addition to the improved means for initial preparation of the waste solids and their delivery to the dispersion tank and the means for removing metal from the waste solids, the dispersion unit includes an impeller and a stationary plate which are positioned in the bottom of the dispersion tank and the impeller rotates with respect to the stationary plate. The facing surfaces of the impeller and plate include interdigitating shear blocks and axial movement between the impeller and plate is provided so that the shear blocks can reduce the solids to smaller and smaller sizes as the impeller and plate near each other. A means is provided for the feeding of a stream of material from above the impeller downwardly through a central opening into the space between the impeller and plate, which is designated the attrition zone, and the stream passes radially outward between the impeller and plate while also being subject to the actions of the shear blocks to reduce the size of the solids. A means is provided to withdraw a stream from the dispersion tank after it has been through the smallest spacing of the impellers to be ~ and that stream is delivered to the accumulation tank. A means is also provided to recirculate material from the accumulation tank to the dispersion tank through a suitable pump, a grinding means and a magnetic trap means. The present invention may be used with all forms of solids, such as tires, wood, waste materials which have been encapsulated in metal drums and other waste materials. The dispersion tank and the transfer means both include means for the removal of metal from the system so that it is not fed to the burner. Additionally, the present invention provides improved means for preprocessing solid wastes to be delivered to the dispersion tank of the present invention which maintains the hazardous waste solids in an inert atmosphere to ensure that no hazardous material is free to escape from the system. By utilizing the attrition zone of the present invention, it can disperse solids and semi-solids in a fluid stream as a part of the function of a rotating impeller.

An object of the present invention is to provide an improved method of preparing hazardous solid wastes which allows them to be readily burned in kiln or industrial furnaces to yield heat and cause their ultimate destruction.

Another object of the present invention is to provide an improved apparatus and method of dispersing hazardous solid wastes in a suitable blend stock so that they may be readily fed to a burner in a kiln or industrial furnace.

Still another object of the present invention is to provide an improved method and apparatus for processing hazardous solid waste which reduces the size of the solids to a sufficient degree that they may be dispersed into a stream of blend stock which can readily be fired.

A further object of the present invention is to provide an improved method and apparatus for processing hazardous solid waste materials so that they may be readily burned with an efficient and simple method which is cost effective to operate and requires little maintenance.

Still another object of the present invention is to provide an improved method and apparatus for reducing the size of solids and dispersing them in a fluid media.

BRIEF DESCRIPTION OF THE DRAWINGS

For a further understanding of the nature and objects of the present invention, reference should be made to the following detailed description taken in conjunction with the accompanying drawings, in which, like parts are given like reference numerals, and wherein:

FIG. 19 is a cross sectional view of the assembly shown in FIG. 18;

FIG. 20 is a cross sectional view of the valve entry system of the dispersion and agitation assembly shown in FIG. 18;

FIG. 22 is a perspective view of the dispersion and agitation system assembly with a portion of the collection ring broken away;

FIG. 23 is a side view of the dispersion and agitation system assembly installed in either the side or in the bottom of a tank;

DETAILED DESCRIPTION OF THE PREFERRED EMBODIMENT

Figure 1:
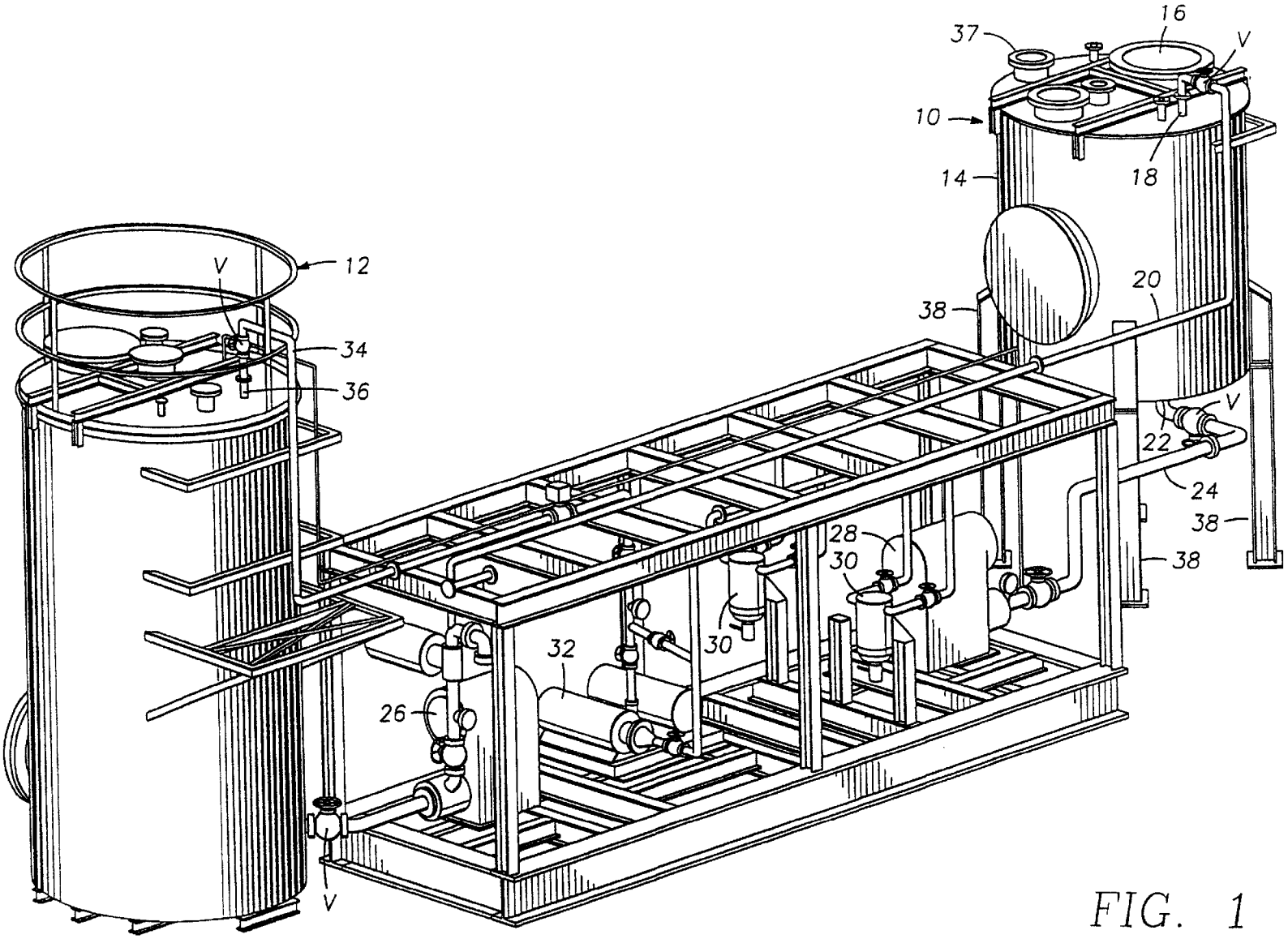
FIG. 1 is a perspective view of the system of the present invention which includes the dispersion unit and the accumulation tank and the components in the circulation system between the dispersion unit and the accumulation tank.

The improved apparatus of the present invention is illustrated partially in FIG. 1 wherein the dispersion unit 10 is shown with the accumulation tank 12 and the elements providing connections therebetween. The feeding of the solid waste materials is more completely illustrated in the other drawings as hereinafter described. Dispersion unit 10 includes tank 14 which includes solids inlet connection 16 in its upper end, recirculated fluid inlet 18 in its upper end and connecting to line 20 and discharge 22 connected into the bottom as hereinafter more completely shown and described and connected to discharge line. Line 20 connects into the lower portion of accumulation tank 12 and through recirculation pump 26 so that fluid in tank 12 can be recirculated to dispersion unit in Line connects to supply pump 28 which is connected through magnetic trap 30 to grinding unit and line 34 leads from grinding unit 32 to the connection 36 on the top of accumulation tank 12. Blend stock is supplied through inlet 37 in the top of tank 14. Dispersion tank 14 is supported on legs 38.

Figure 2:
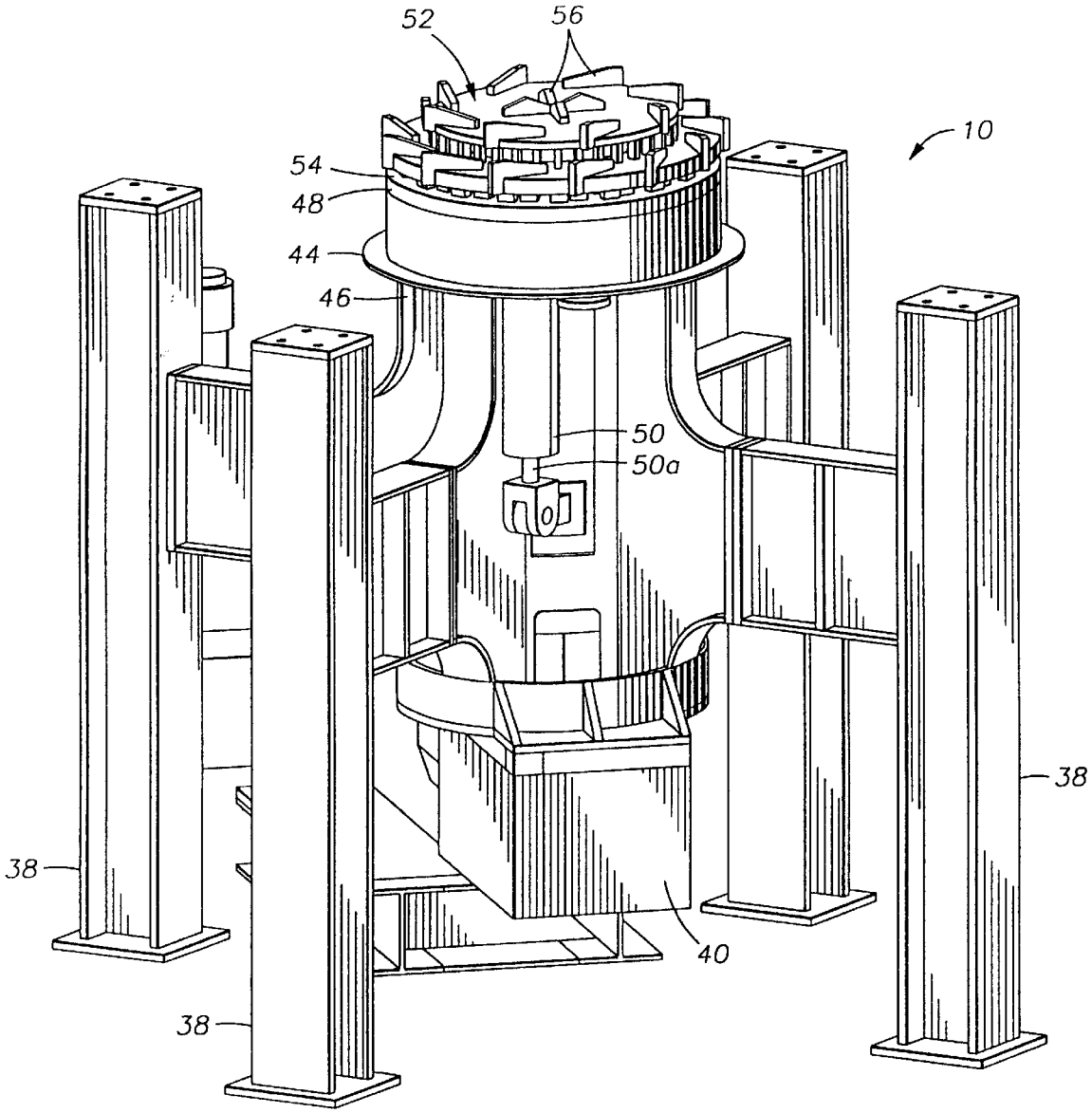
FIG. 2 is a side view of the operating equipment installed in and below the lower end of the dispersion tank with the tank removed for clarity.
Figure 3:
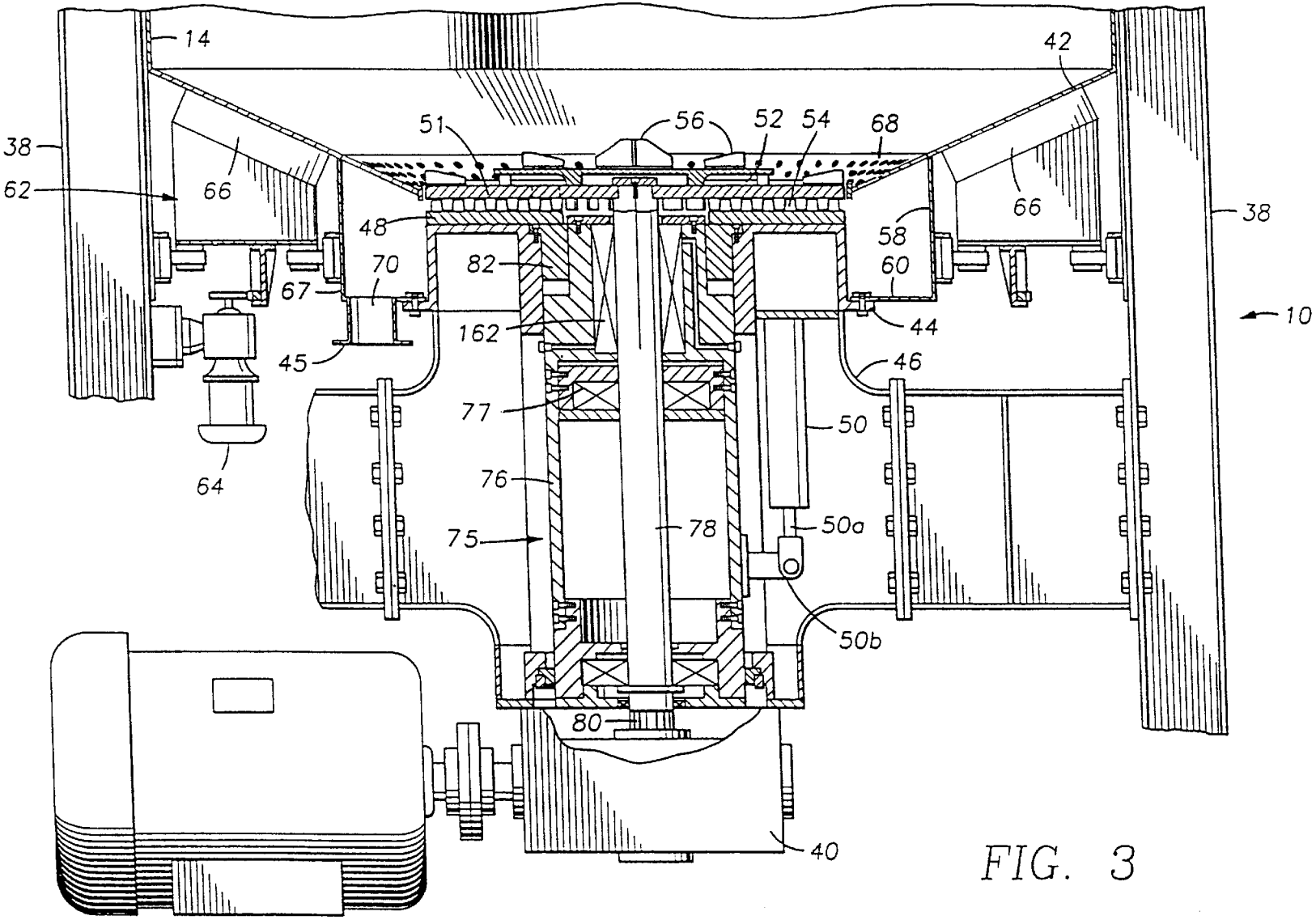
FIG. 3 is a sectional view of the lower end of the dispersion tank and the equipment contained therein and therebelow.
Figure 4:
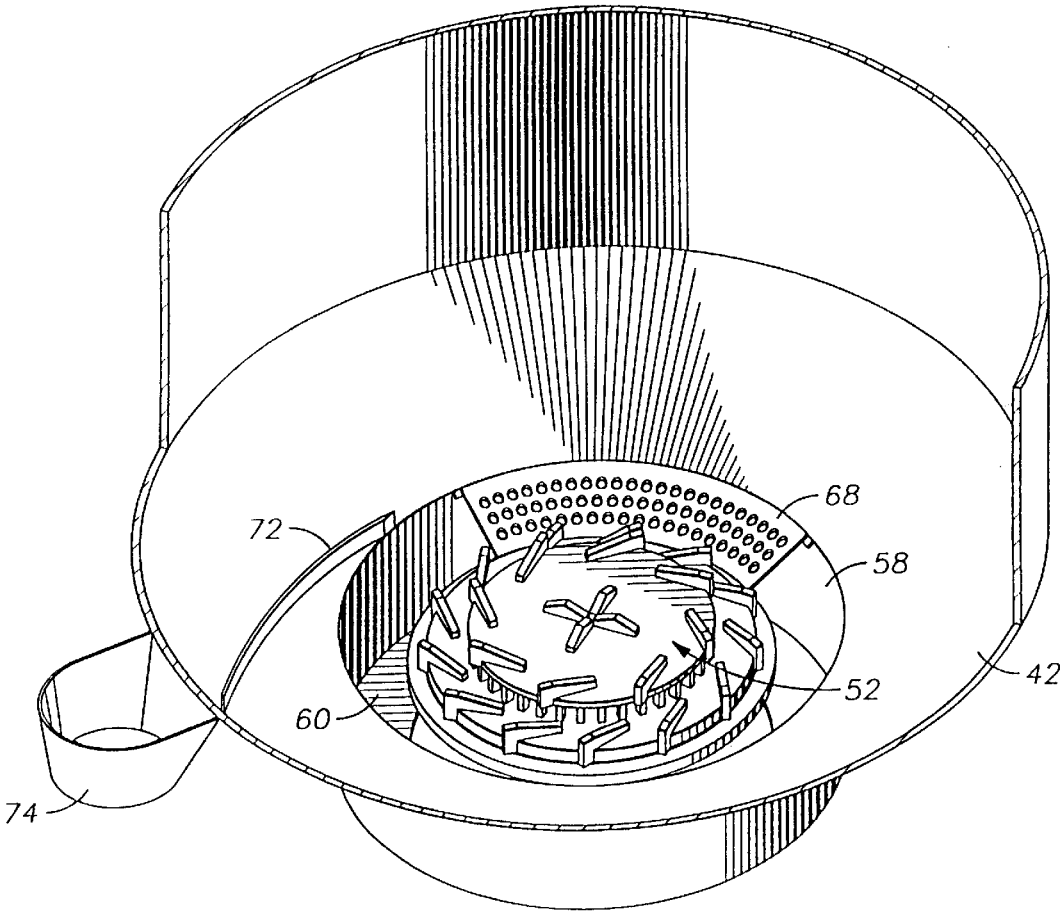
FIG. 4 is a perspective view of the equipment in the lower end of the dispersion tank.
Figure 5:
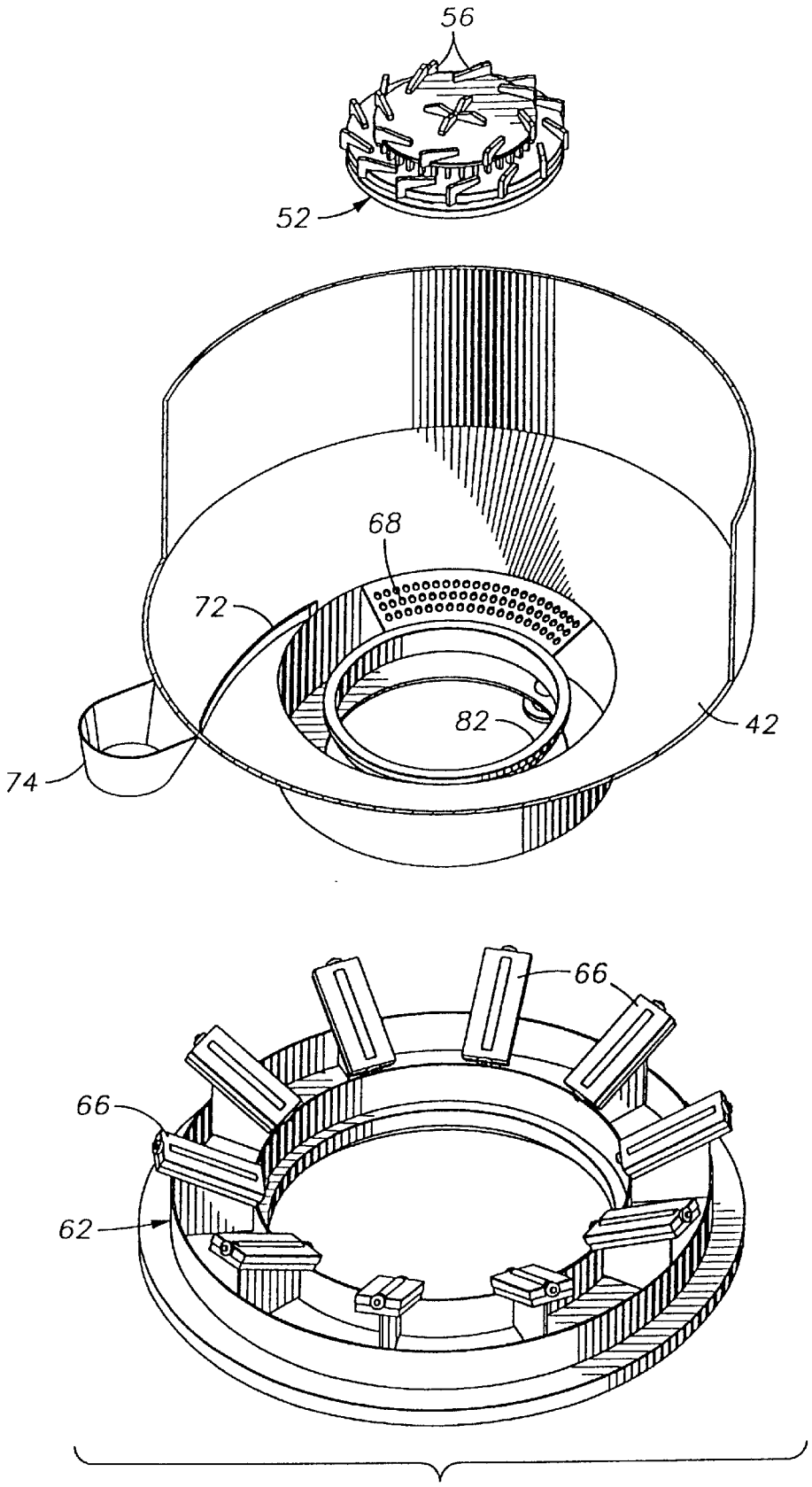
FIG. 5 is an exploded view of the dispersion equipment with the stationary plate removed for clarity.

FIG. 2 illustrates dispersion unit 10 with tank 14 removed for clarity. Main drive 40 is supported centrally below the center of tank 14 which has conical bottom 42 which, as shown in FIG. 3, is secured to flange 44 on support structure 46. Stationary plate 48 is supported above flange 44 and cylinder 50 which is supported on support structure 46 and connects to impeller 52. Thus, cylinder 50 can raise and lower impeller 52 with respect to stationary plate 48 to control the spacing therebetween which is designated the attrition zone54. Impeller 52 includes a plurality of vanes 56 on its upper surfaces to cause circulation of the fluid within the lower portion of the tank 14 and function during rotation as hereinafter described. Conical bottom 42 includes downwardly extending cylindrical section 58 and radially extending flat section 60 which connects to flange 44. Trolley 62 is supported between legs 38 and cylindrical section 58 and is rotated for the purpose hereinafter described by motor 64. Trolley 62 supports magnets 66 which are positioned immediately under bottom 42 which is of a nonmagnetic material. Perforated plate 68 is secured to the inner conical portion of bottom 42 and terminates a short radial distance outward from the outer edge of stationary plate 48. Outlet 70 is connected through radial section 60 and line 24 to supply pump 28 wherein it is delivered to accumulation tank 12. As can be seen from FIG. 4, the iron metal which reaches the bottom of tank 14 is attracted by the rotating magnets 66 and pulled around the bottom 42 until it reaches fence 72 which is secured to the upper surface of the conical portion of bottom 42 as shown and leads to metal discharge 74.

The linear movement of impeller 52 is possible because the upper end of cylinder 50 is secured to the support structure 46 immediately under flange 44 and the rod 50*a* is connected to bracket 50*b* that is secured to fixed cylinder 76, of the quill assembly 75, surrounding drive shaft 78. The quill assembly 75 is axially movable and its movement moves impeller 52 and drive shaft 78. Drive 40 is connected to drive shaft 78 by spline connection 80 which allows the relative movement between drive shaft and drive 40. Wear ring 82 is secured to support connection 46 and surrounds the upper end of cylinder 76.

Figure 6:
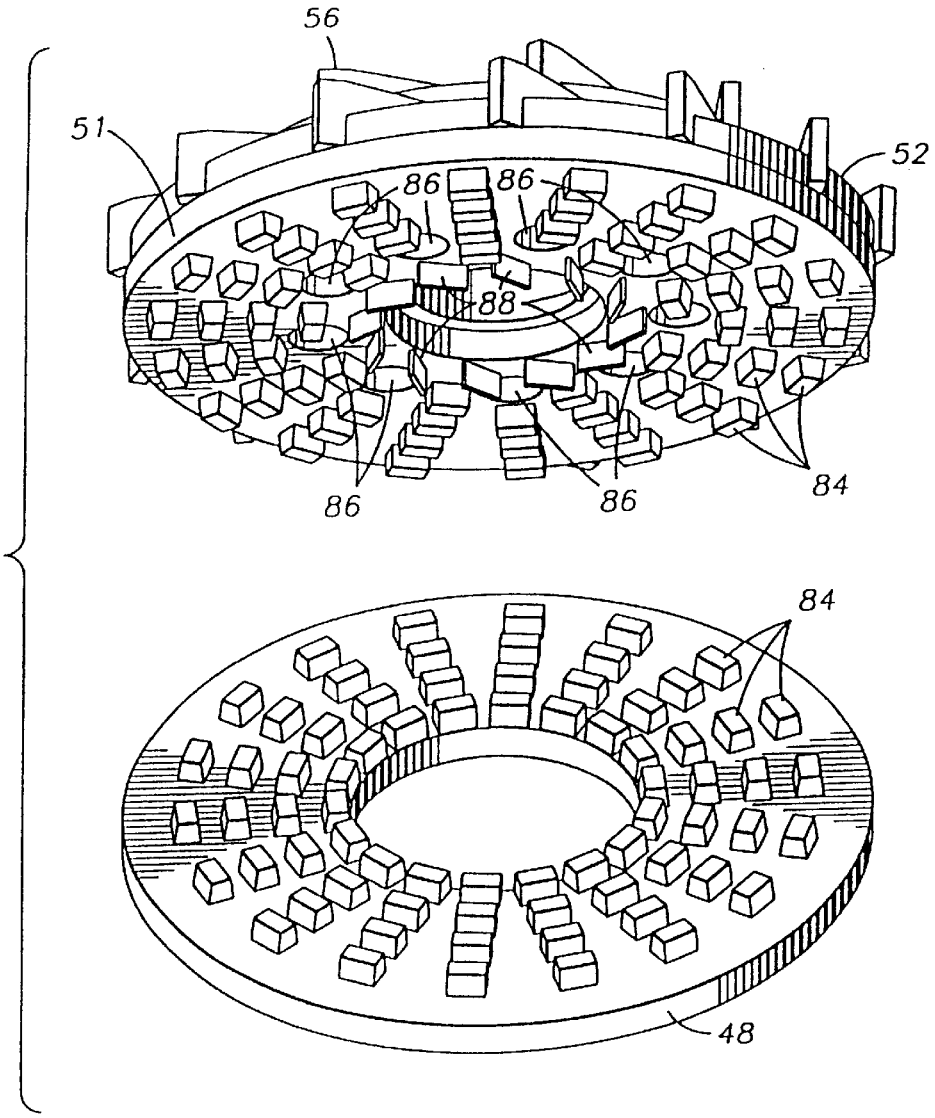
FIG. 6 is and exploded view of the impeller and stationary plate to illustrate the interdigitating shear blocks which perform the reduction is size of solids passing through the attrition zone.

As shown in FIG. 6, the upper side of stationary plate 48 and the lower surface of impeller 52 each include a plurality of shear blocks 84 which are spaced relative to each other so that with rotation of impeller 52 they interdigitate or intermesh. As best seen also from FIG. 6, ports 86 extend through impeller 52 50 that fluid being processed is conducted into attrition zone 54 to flow outward between plate 48 and impeller 52. Vanes 88 are positioned inwardly of ports 86 so that the rotation of impeller 52 causes the fluids and solids to flow through attrition zone 54. This flow is best seen in the detail of FIG. 20.

Figure 9:
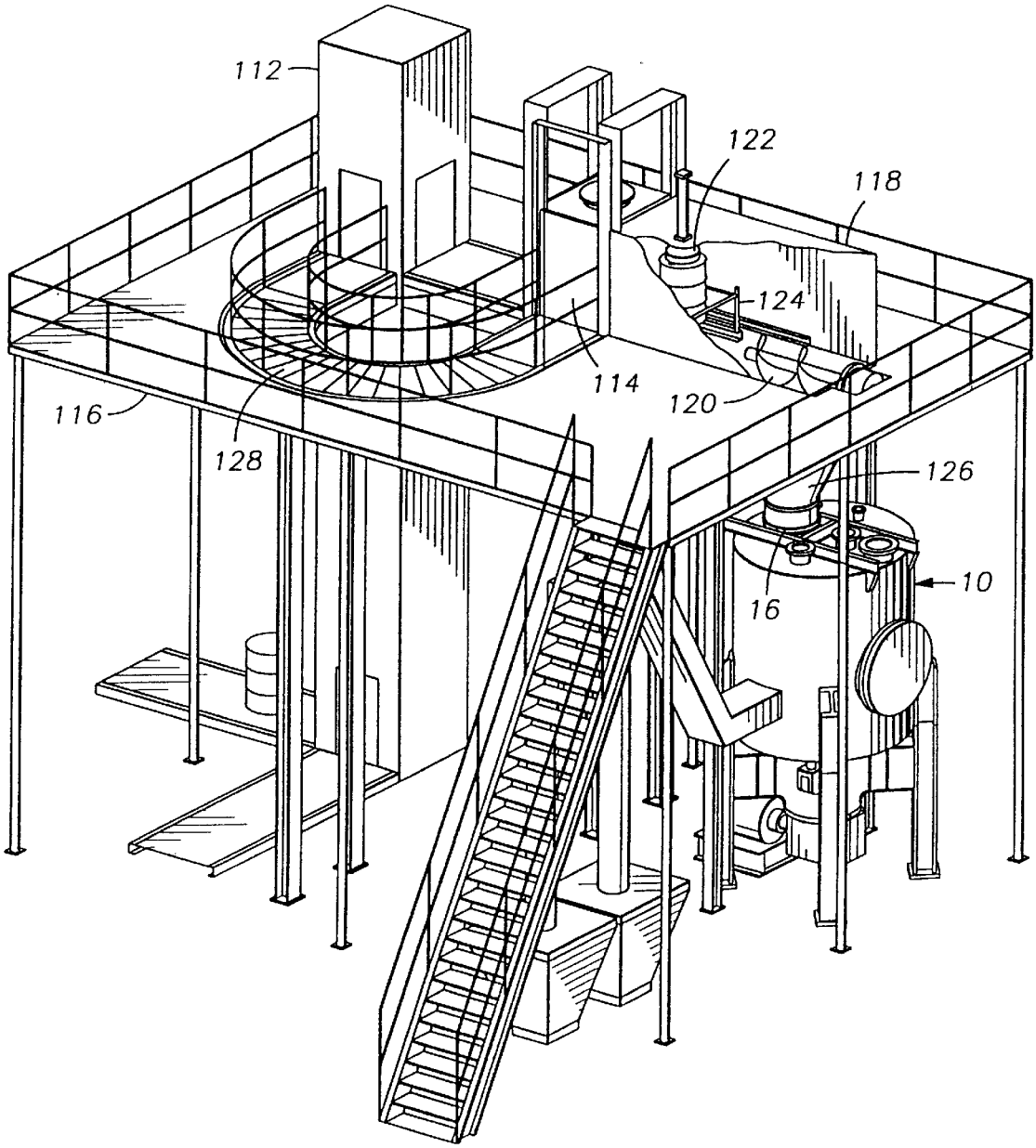
FIG. 9 is a perspective view of a drum augering and feeding system.
Figure 10:
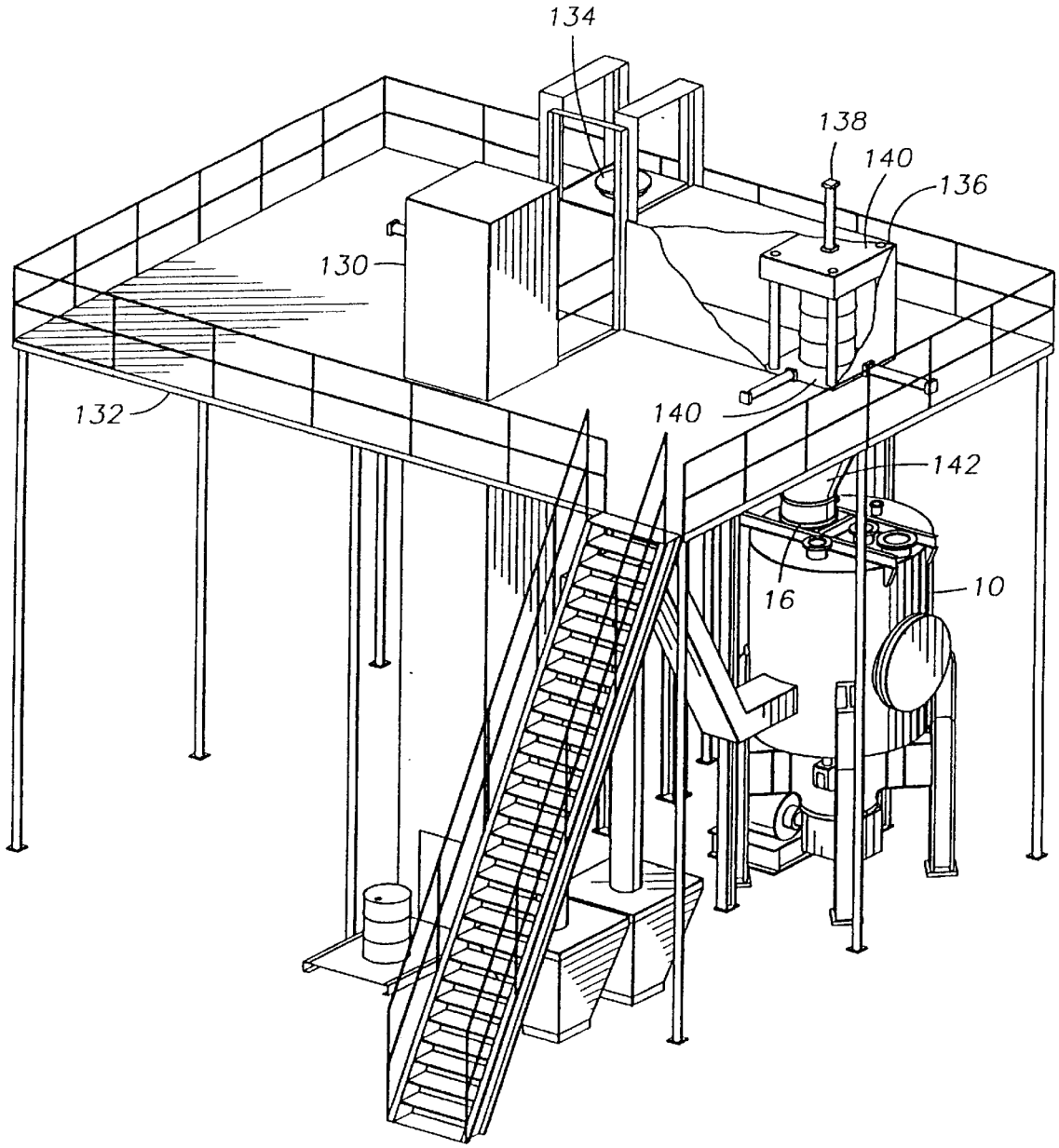
FIG. 10 is a perspective view of a drum extrusion and feeding system.
Figure 11:
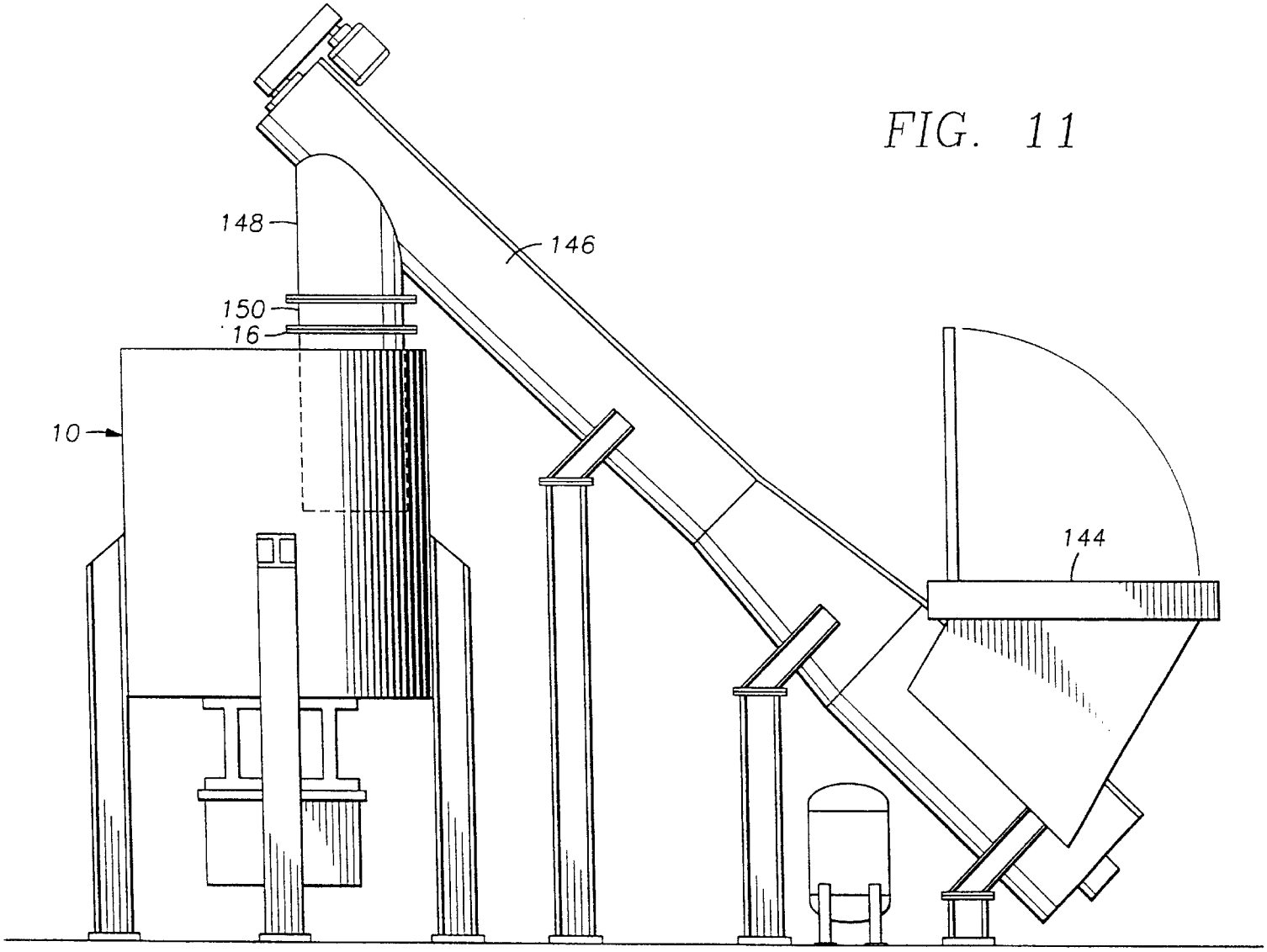
FIG. 11 is an elevation system of a bulk feed conveyor for delivering solids to the dispersion unit of the present invention.

Several different methods of feeding the solids to dispersion unit 10 are illustrated in FIGS. 8 through 11. As hereinafter discussed, these systems include a drum shredding system (FIG. 8), a drum angering system (FIG. 9), a drum extrusion system (FIG. 10), and a bulk feeding system (FIG. 11).

Figure 8:
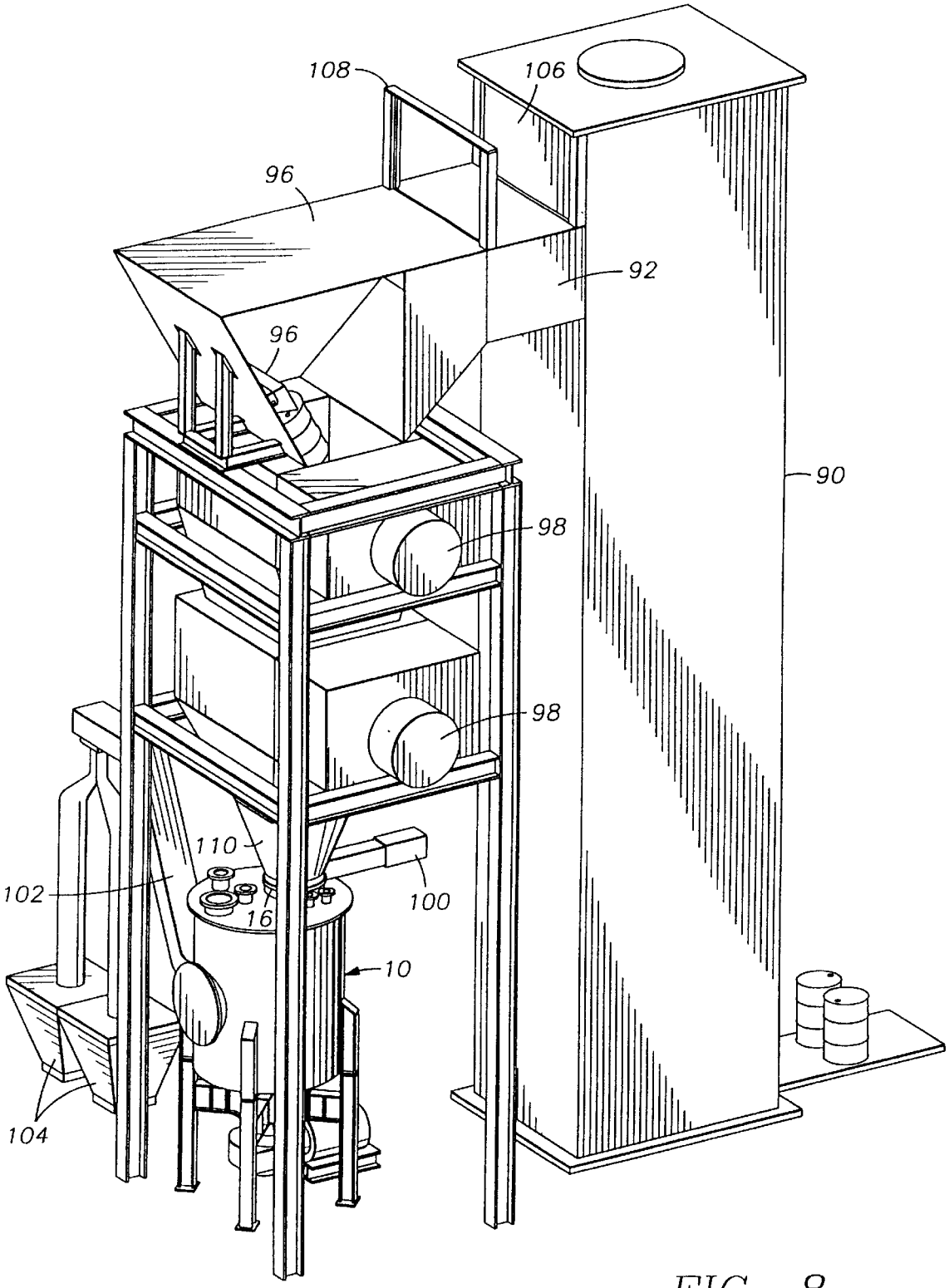
FIG. 8 is a perspective view of a drum shredding and feeding system.

The drum shredding system shown in FIG. 8 is utilized to prepare whole drums of material for feeding into the dispersion system. It includes drum elevator 90, having a suitable air lock enclosure 92, shredding chamber 94, drum feeding ram 96, shredders 98,isolation gate 100 connecting between the system and the inlet 16 on dispersion tank 14 together with such safety equipment as means for supplying an inert atmosphere, fire protection systems and emergency relief systems. Also, illustrated in FIG. 8 is dispersion unit 10 which includes metal separation and conveyor 102 hereinafter described to deliver the waste and scrap metal to waste hoppers 104.

Drums to be shredded together with the materials which they contain are delivered to the loading platform and moved into the elevator 90 where they are raised upward and then moved into air lock enclosure 92. When the drums have been moved into air lock enclosure 92 the lock door 106 between elevator 90 and enclosure 92 is closed. After providing an inert atmosphere to enclosure 92, inner lock door 108 is opened. During the time that the drums are being moved to this point they are closed so that waste material does not escape. After the drums are within the shredding chamber they are engaged by drum feed ram 96 which feeds the drums into the upper shredder 98. The discharged of shredded material from the upper shredder 98 is fed into the lower shredder 98 for further reduction in size of the drums and the waste material which was originally contained within the drums. It should be noted that multiple shredders can be used in series, in parallel or in any combination of both which produces the desired size of waste material and drum metal. Chute 110 connects the discharge of the lower shredder 98 into inlet connection 16 on dispersion unit 10.

In operation of the drum shredding system, one or more drums are transported by elevator 90 to the level of air lock enclosure 92. The shredding system outer air lock door 106 opens and a conveyor transports the drum horizontally into the air lock chamber 92. This time, the inner air lock door 108 remains closed to isolate the air lock chamber 92 from the environment. Once the drum is inside the air lock chamber 92, the outer air lock door 106 closes and the chamber 92 is automatically purged with inert gas until the resulting oxygen level is well below ignition concentrations. Once this condition has been satisfied, the inner air lock door 108 opens and the drum is conveyed into the shredding chamber 94 where it falls into the upper shredder 98. The inner air lock door 108 closes and the feed cycle for another drum charge begins. Meanwhile, the feed ram 96 travels down vertically to provide a positive feed of the drum into the upper or primary shredder 98. It retracts to its home position when hill extension of the ram 96 has occurred. Shredded product leaves the primary shredder and falls into the secondary shredder 98*a* below. The secondary shredder 98*a* is generally equipped with narrower teeth so that the resulting shredded material is further reduced in size. Shredded material leaves the secondary shredder 98*a* and is discharged into the dispersion unit 10.

A drum auger system is illustrated in FIG. 9 and includes drum elevator 112 which receives drums and elevates them to the level of air lock chamber 114 immediately below platform 116. The air lock chamber 114 is connected to auger chamber 118 which includes a suitable rotating auger 120. A suitable drum lid remover 122 is provided and drum carriage 124 supports the drums and presents them in a position so that the auger 120 can enter the open top of the drum and auger the material therefrom. The material is discharged through chute 126 into the inlet 16 on dispersion unit 10. It should be noted that a shredder may be included in connection with chute 126 if needed. The empty drum exits the air lock chamber 114 onto conveyor 128 on platform 116 and is returned by elevator 112 to the lower level for disposal or transportation to a suitable location for reuse.

A drum extrusion system is illustrated in FIG. 10 and includes elevator 130 which extends from ground level to a level above platform 132. Drums elevated in elevator 130 are discharged into airlock chamber 134 and into extrusion chamber 136. An extruder ram 138 is used to compact the drums between upper and lower platens 140*a* and 140*b*, respectively. It is noted that the end of the drum may be removed or opened in any suitable manner prior to the extrusion step. Extrusion chamber 136 is positioned immediately above chute 142 which may include a shredder and connects to solid waste inlet 16 of dispersion unit 10. Thus when ram 138 compacts a drum, its contents are forced into chute 142 and the compacted drum is then removed from between platens 140*a* and 140*b* and discharged from the system through air lock chamber 134 and elevator 130 or other suitable means. It is suggested that the compacted drums be washed with an automatic high pressure washing system before being removed from extrusion chamber 136.

A bulk feed system is illustrated in FIG. 11 and includes feed bin 144 which connects to and feeds the lower end of screw conveyor 146. Screw conveyor 146 elevates the material to the upper end 147 wherein it is discharged through duct 148 and isolation gate 150 into the inlet 16 of dispersion unit 10. If desired, a shear shredder may be positioned in duct 148. The bulk feed system allows the feed and processing of material which is not containerized. In general, a totally enclosed screw conveyor 146 or drag conveyor is used to transport bulk material from a feed hopper to the dispersion units. The feed conveyor 146 is variable speed to yield any desired feed rate and the feed hopper 144 is sized to accommodate a tilt hopper load or a track hoe bucket load. It may also contain an isolation gate similar to that used in duct 148 for use when the bulk feed conveyor is not in service. A transition chute 148 routes the extruded material through a shredding device and then into the dispersion unit 10. Material is washed from the feed conveyor flights and down the transition chute 148 by a flow of blended material from the dispersion system.

Alternately, bulk material can be fed to a freestanding bin. After filling, the bulk feed bin is closed, then elevated and discharged into a shredding system configured similar to the drum shredding system shown in FIG. 8. This approach allows the direct deposit of material from dump trucks and other transport containers directly into the feed system without the need for further manipulation.

Figure 12:
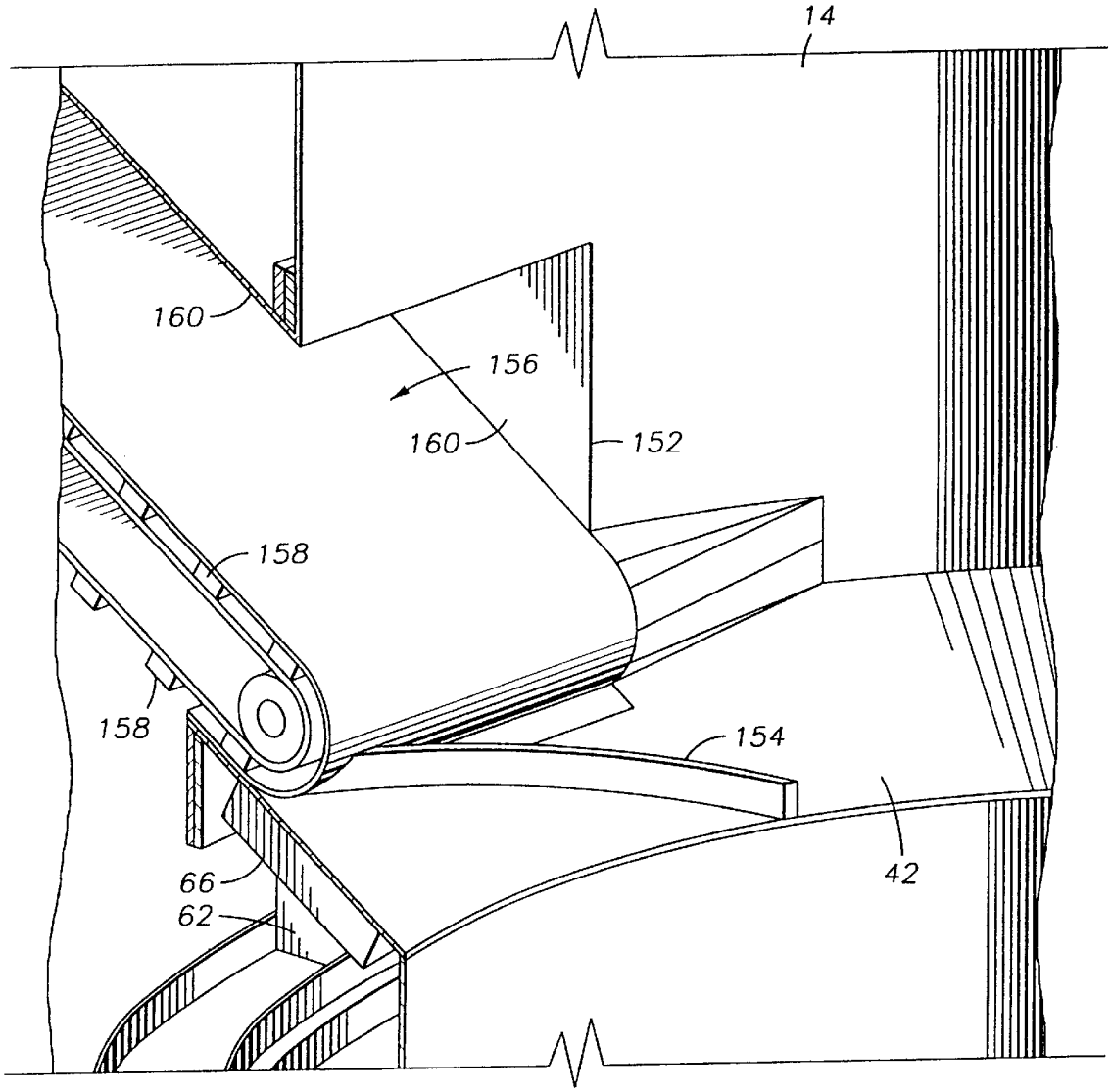
FIG. 12 is a schematic sketch of another form of magnetic conveyor system to be used for removing metal from the bottom of the dispersion unit.

A modified apparatus for the removal of metal from dispersion tank 14 is illustrated in FIG. 12. Tank 14 is shown with metal outlet 152 extending therefrom immediately above conical bottom 42. The magnets 66 are supported on trolleys 62 and rotate under bottom 42 causing the metal particles within tank 14 which settle to the bottom to move around bottom 42 to wiper 154. Wiper 154 directs the metal toward outlet 152 and removal conveyor 156 which includes magnets 158 in association therewith as shown. Thus, the metal fragments are picked up and discharged through outlet 152 in an upwardly direction. Ducting 160 surrounding outlet 152 extends upwardly to a level above the maximum liquid level to be maintained within dispersion tank 14 and removal conveyor 156 extends into a chamber (not shown) at the upper end of ducting 160 into which the metal fragments are dropped and discharged from dispersion unit 10 through a suitable chute (not shown) to a suitable collection site (not shown). The upward incline of conveyor 156 allows any waste solids other than the metal fragments to flow downwardly into the lower end of tank 14 so that the metal fragments are discharged from the system with only a minimum of the blend stock.

Figure 1A:
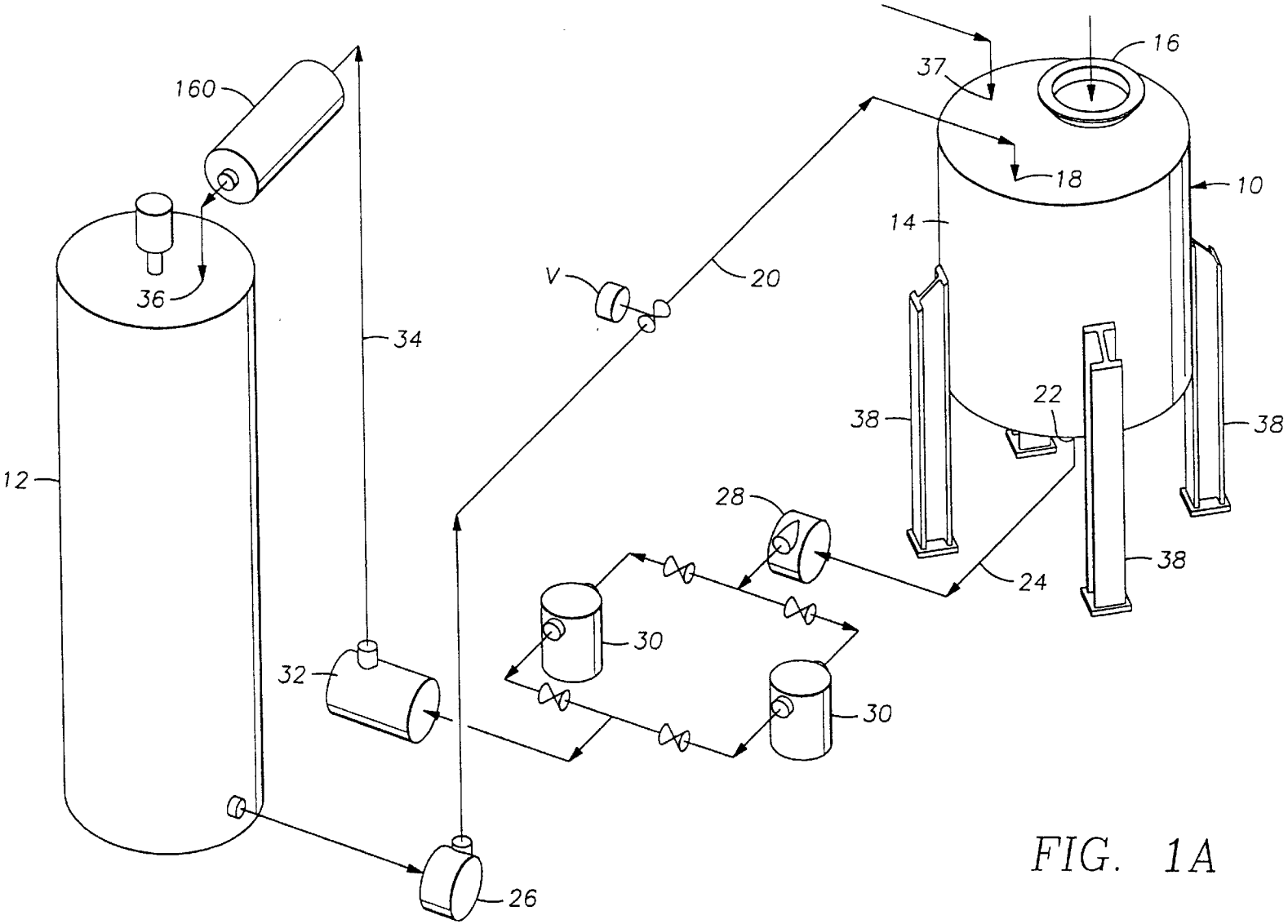
FIG. 1A is a schematic view of the system shown in FIG. 1 which more clearly illustrates the basic connections between the accumulation tank and the dispersion unit.

It should be noted with reference to FIGS. 1 and 1*a* that valves V are used to control the flow of fluids within the system and may thus be used to control the level of the liquid dispersion in tank 14 and also the flow of such liquid dispersion through the system, such as the recirculation of the liquid dispersion into the dispersion unit 10 for further size reduction of the solid particle size in the liquid dispersion.

In operation an organic liquid known as "blend stock" is first pumped into the system to establish a normal operating level in dispersion unit 10 and a minimum operating level in accumulation tank 12. All pumps are then started to establish a continuous flow from dispersion unit 10 through the grinding unit 32 to accumulation tank 12. Recirculation pump 26 supplies flow back to dispersion unit 10 from accumulation tank 12. With this arrangement, material is continuously recirculated through the dispersion system so that many passes can be made through dispersion unit and grinding equipment. Addition of solid waste to the system ultimately leads to the increase in operating level in accumulation tank ~2 since the operating level of dispersion unit is held constant throughout the process. After establishing the recirculation loop, waste material can be continuously fed into inlet 16 of dispersion tank 14. Dispersion unit 10 separates and removes shredded drum metal, and the remainder of the waste resides within the system until it is reduced sufficiently to meet the required specifications. A batch of blended Rid is completed when accumulation tank 12 is full and the material meets the required specifications. Once the batch nears completion, the feed of waste material is stopped. Material can be recirculated through the dispersion system when attrition zone 54 is automatically closed to a minimum gap cylinder 50. This insures the finest particle size possible. The system can then be pumped out and the cycle is ready to begin again with the input of new blend stock. The system can also be operated in a continuous mode by constantly removing a side stream from accumulation tank 12 at a rate equal to the input rate of waste and blend stock to the system.

Dispersion unit 10 when charged causes impeller 52 to rotate. The impeller drive shaft 78 supports a mechanical seal assembly 162 (FIG. 3) to isolate the contents of dispersion tank 14 from the environment. The mechanical seal assembly 162 further serves to hold the bearing 77 in place in a manner which minimizes shaft length between the bearing 77 and the impeller 52 thus reducing shaft deflection and run-out to an absolute minimum. The mechanical seal assembly 162 and the quill assembly 75 move togeather as a unit. Therefore, the vertical position of the impeller 52 relative to the fixed impeller 48 is variable and controlled by the positioning of the quill assembly 75. It is this variable displacement which controls the particle size of the solids dispersed. Shredded ferrous metal will be continuously removed from tank 14 through metal discharge 74 or through outlet 152. The solid waste material will reside within dispersion system until it is properly ground and suspended in the liquid carrier or blend stock. Dispersion unit impeller 52 is believed to grind and disperse material in three ways. First, impeller 52 produces turbulent hydraulic flow patterns within the lower portion of tank 14 which tend to shear material as high velocity fluid leaving the impeller 52 impinges upon solids. Second, the top of impeller 52 is equipped with vanes 56 which induce hydraulic flow and circulation within tank 14. These vanes 56 also provide coarse grinding through mechanical action against solids which they strike. Finally, the underside of impeller 52 and the upper side of stationary plate 48 include intermeshing shear blocks 84 within attrition zone 54 which provide fine grinding by physically taking in the solids and shearing them against closely spaced shear blocks 84. Attrition zone 54 is composed of two disks which have a series of shear blocks mounted in circular patterns on each disk. One disk is bolted or in other ways suitably secured to the dispersion tank 14 and held stationary while the other disk is bolted to the underside of impeller 52 and rotates with it. Material enters attrition zone 54 through ports 86 near the center of impeller 52. Flow into attrition zone 54 is induced by a series of forward sweeping vanes 56*a* mounted on top of impeller 52. Vanes 56*a* tend to pressurize the inlet to attrition zone 54. Spacing between inlet vanes 56*a* limits the size of solid particles that are allowed to enter attrition zone 54. This configuration avoids plugging of attrition zone 54. Finally, centrifugal forces created by the rotation of impeller 52 prevent larger particles from changing direction and entering between inlet vanes 56*a*. Flow is further induced through attrition zone 54 by the centrifugal force generated by the rotation of impeller 52. The shear blocks 84 on the impeller 52 actually travel within the circular paths occurring between the shear blocks 84 on the opposed stationary plate 48. The shear blocks 84 thus intermesh and provide shearing action as the rotating blocks capture material between stationary blocks. Fluid enters attrition zone 54 near the center of impeller 52, and it exits radially due to the centrifugal forces induced by impeller 52. As a particle travels radially, is sheared repeatedly. The angular velocity of the shear blocks 84 increases as the particle travels radially so that an increasing finer grind is obtained before the particle exits attrition zone 54. The intermeshing design also ensures that attrition zone 54 is self-clearing and will not plug. The shear blocks 84 are tapered vertically and impeller height is controlled by the operation of cylinder 50. With this arrangement, the gap between shear blocks 84 can be controlled to yield any desired particle size. In the event it is found desirable an alternate design utilizing an impeller without the adjustment of the height of the attrition could be used but the particle size will be held constant and no compensation for wear of shear blocks 84 is available as it is with this height adjustment system. Fluid leaving the attrition zone (along the path indicated by arrow $F_1$ is discharged into an annular collection ring 53 positioned around the discharge perimeter of impeller 52. The discharge ring assembly 67 contains top plate 68 which has a series of perforations 68*a*. A pump suction nozzle 45 is also located within the bounds of discharge ring assembly 67. In this way, pump suction is guaranteed to contain only material which has traveled through attrition zone 54. All excess fluid entering collection ring 53 simply exits into the main stream through the perforations 65*a* in plate 68 (along the path indicated by arrow $F_2$). Material may recirculate through attrition zone 54 many times before finally being captured in pump suction nozzle 45. Plate 68 and bottom 42 of tank 14 are frusto-conically shaped and adjoining so that material will naturally migrate to impeller 52 which is located at the low point of their partial cones. The dispersion system utilizes equipment that imparts mechanical energy into the processed liquid as heat. As a result, the temperature of the liquid is likely to rise as it is being processed. Excessively high temperatures will overload the emission control system as well as thicken the blended product due to evaporation of blend stock. To avoid this problem, a cooling system is suggested to control the temperature of the blended liquid. A heat exchanger 164 (FIG. 1A) or other suitable means maybe used. Any of the solid feeding system described herein may be used with the improved system of the present invention and should be selected based upon the character of the waste material which is to be processed. Since the waste material being processed is generally hazardous, it is important that such feeding system make provision to isolate the material from the environment and also exclude oxygen from the system to prevent problems with premature combustion of the material.

Figure 13:
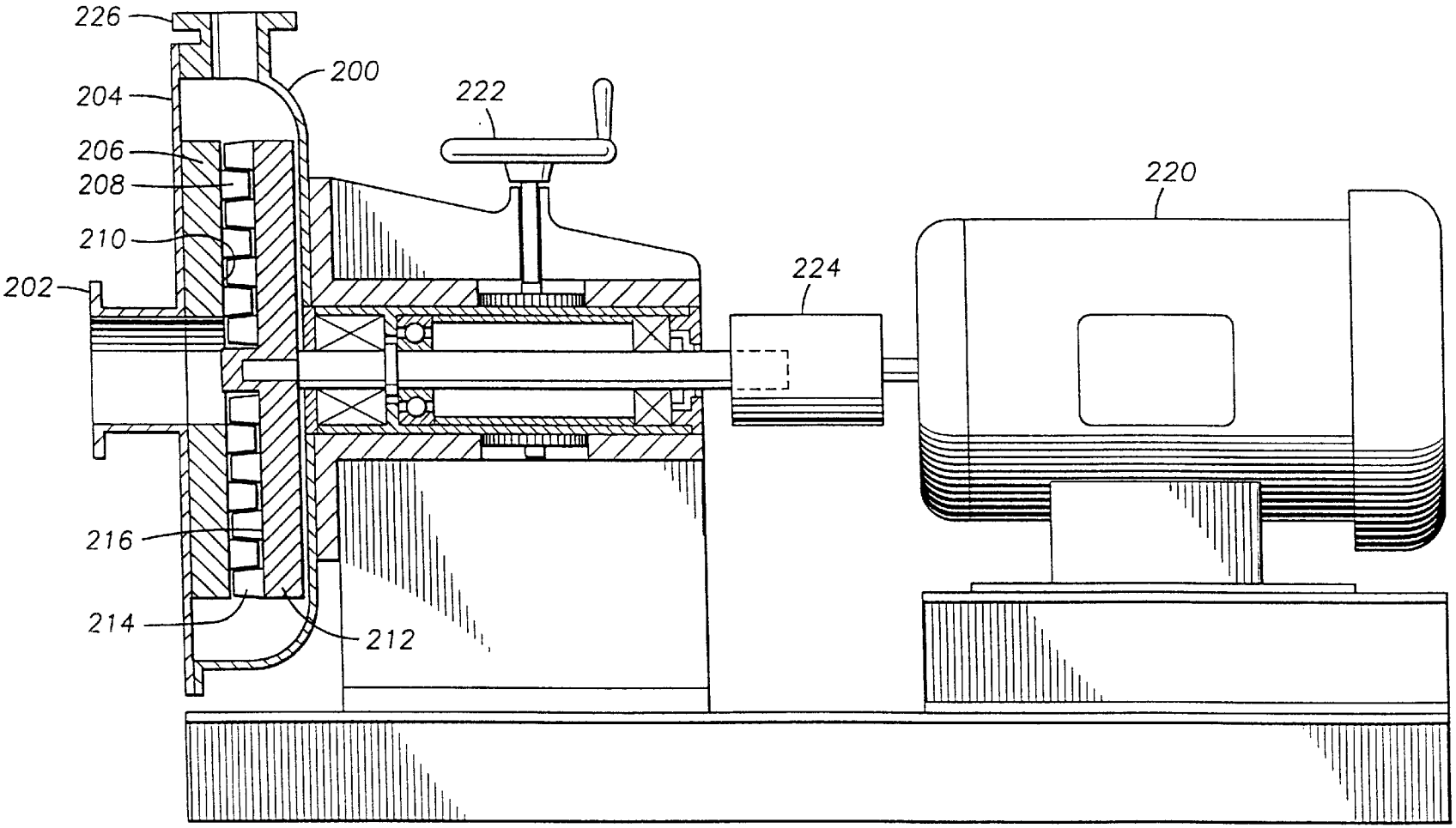
FIG. 13 is an elevation view of an attrition mill for both macerating solids and dispersing them in the fluid stream flowing through the device.

Mill 200 as shown in FIG. 13 is a modified dispersion apparatus and includes inlet 202 into mill housing 204. Stationary plate 206 is positioned on the interior of housing 204 immediately surrounding the opening of inlet 202 therethrough. Shear blocks 208 are secured to the inner surface 210 of plate 206. Rotating disc 212 is positioned within housing 204 and has shear blocks 214 positioned on its surface 216 facing the shear blocks 208 on plate 206. Shear blocks 208 and shear blocks 214 are so positioned to intermesh. Rotating disc 212 is mounted on drive shaft 218 which is rotated by motor 220. Also, as with the impellers previously described, drive shaft 218 is axially movable to change the spacing between stationary plate 206 and rotating disc 212 50 that the macerating action of shear blocks 208 and 214 causes any solids entering mill 200 to be more finely ground. Hand wheel 222 is connected to worm gear 223 which causes movement of drive shaft 218. This movement is possible because of the spline coupling 224 connecting drive shaft 218 with motor 220. Fluids including the finely ground dispersed solids are discharged from housing 204 through discharge 226. Mill 200 is a modified form of the present invention but is suitable for uses that involve the fine grinding of materials which are delivered thereto in a fluid and the dispersion of the ground materials in the fluid discharged from the mill 200.

Figure 14:
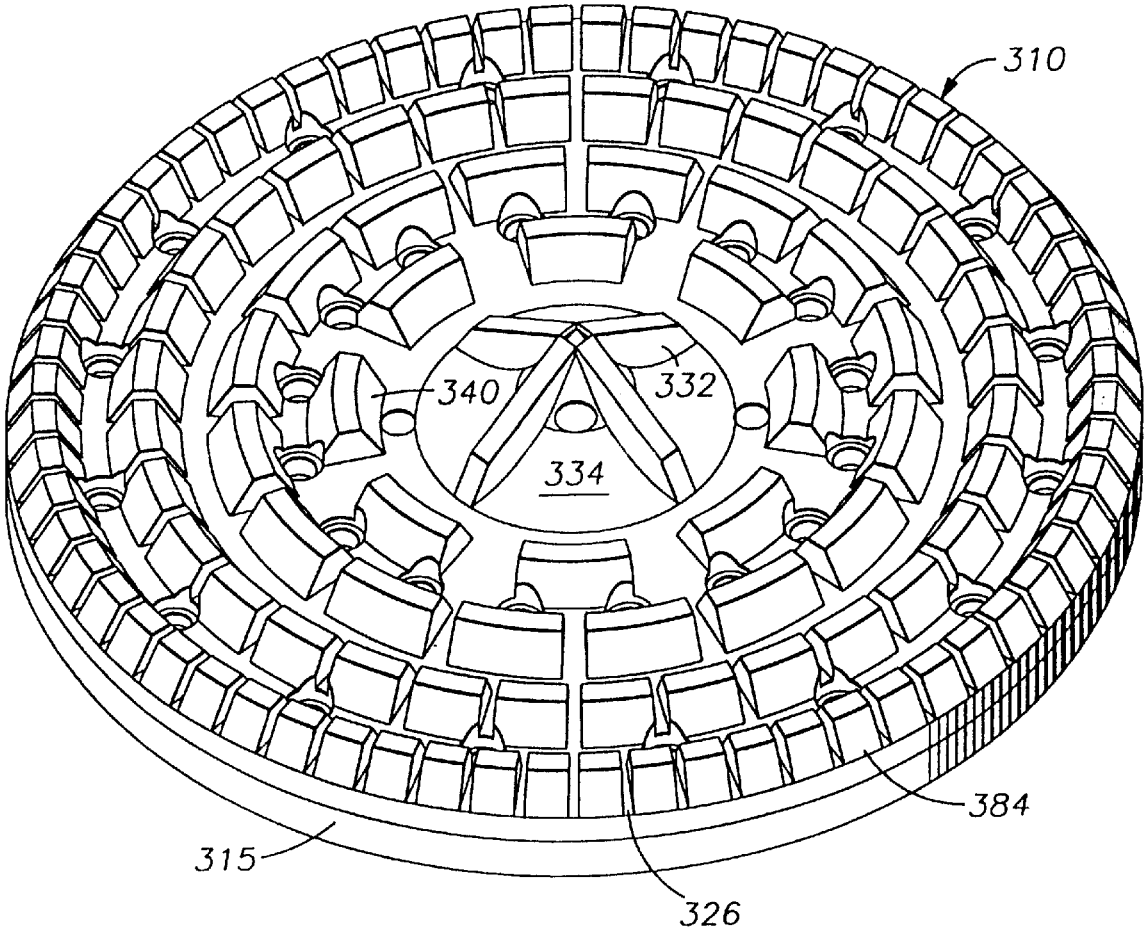
FIG. 14 is a perspective view of a rotor wherein the spacing between the teeth bears an inverse relationship to the distance of the teeth from the center of the rotor.
Figure 15:
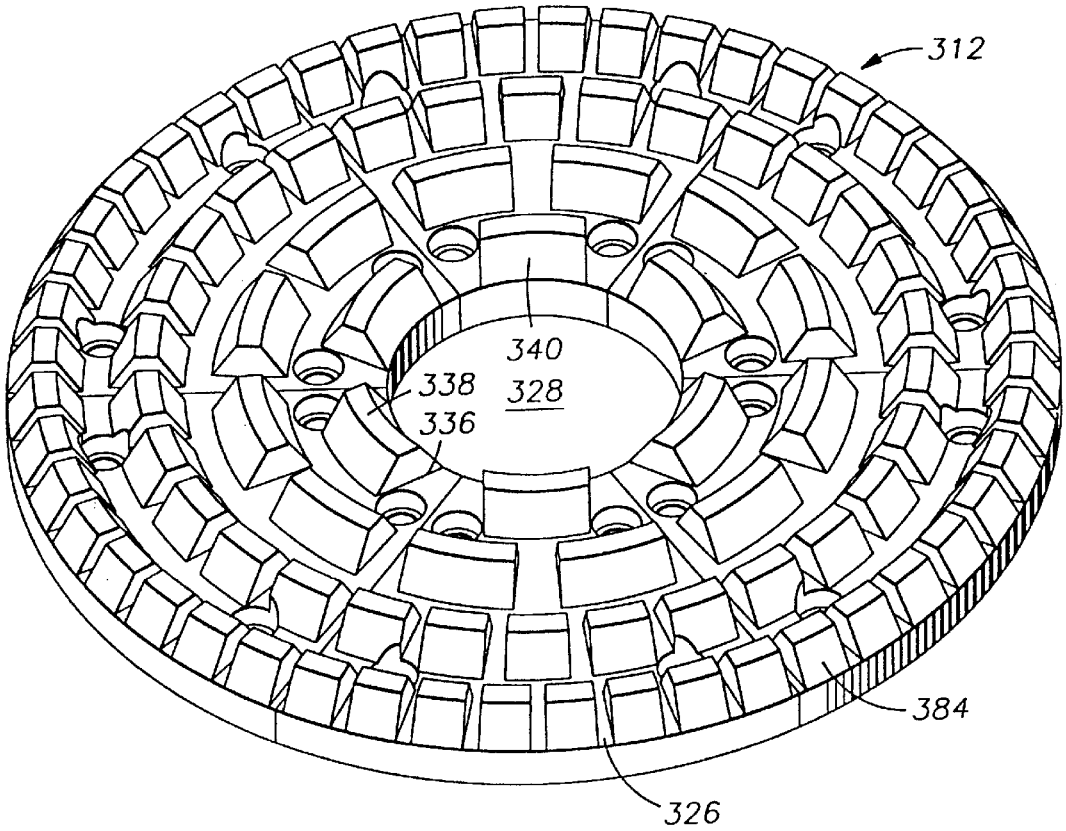
FIG. 15 is a perspective view of a stator wherein the spacing between the teeth bears an inverse relationship to the distance of the teeth from the center of the stator.

FIG. 14 shows an alternate design of the rotor 310 plate. FIG. 15 shows an alternate design of the stator 312 plate. The rotor 310 and stator 312 plates come together to form the attrition zone 360 (FIG. 19). Typically, the rotor 310 and stator 312 plates shown in FIGS. 14 and 15 would be used in a disk attrition mill but the principles embodied therein may apply regardless of the particular application For example, the illustrated rotor 310 and stator 312 plates may be used in any dispersant and agitation system where a fluid such as a liquid, or a liquid mixed with another liquid, or a liquid mixed with solids needs to be made into a more homogeneous mixture.

Figure 16:
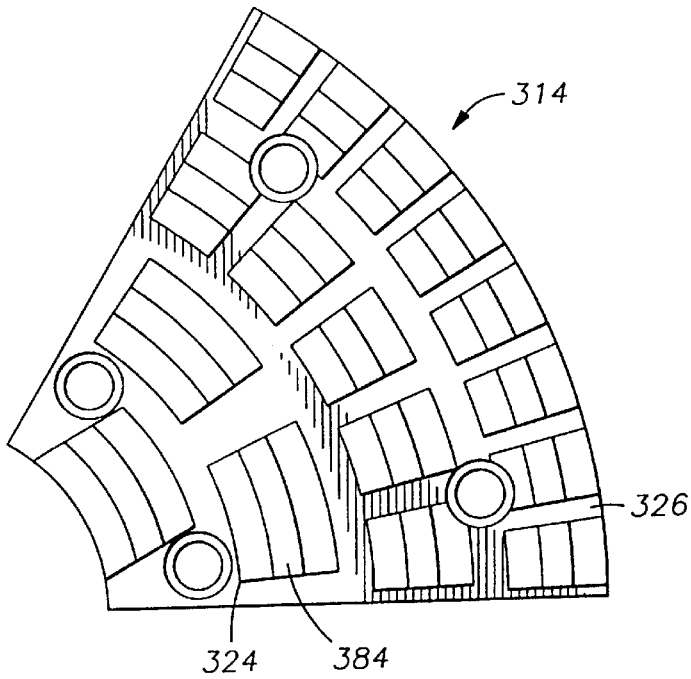
FIG. 16 is a plan view of a pie or wedge-shaped segment of a stator or rotor.
Figure 17:
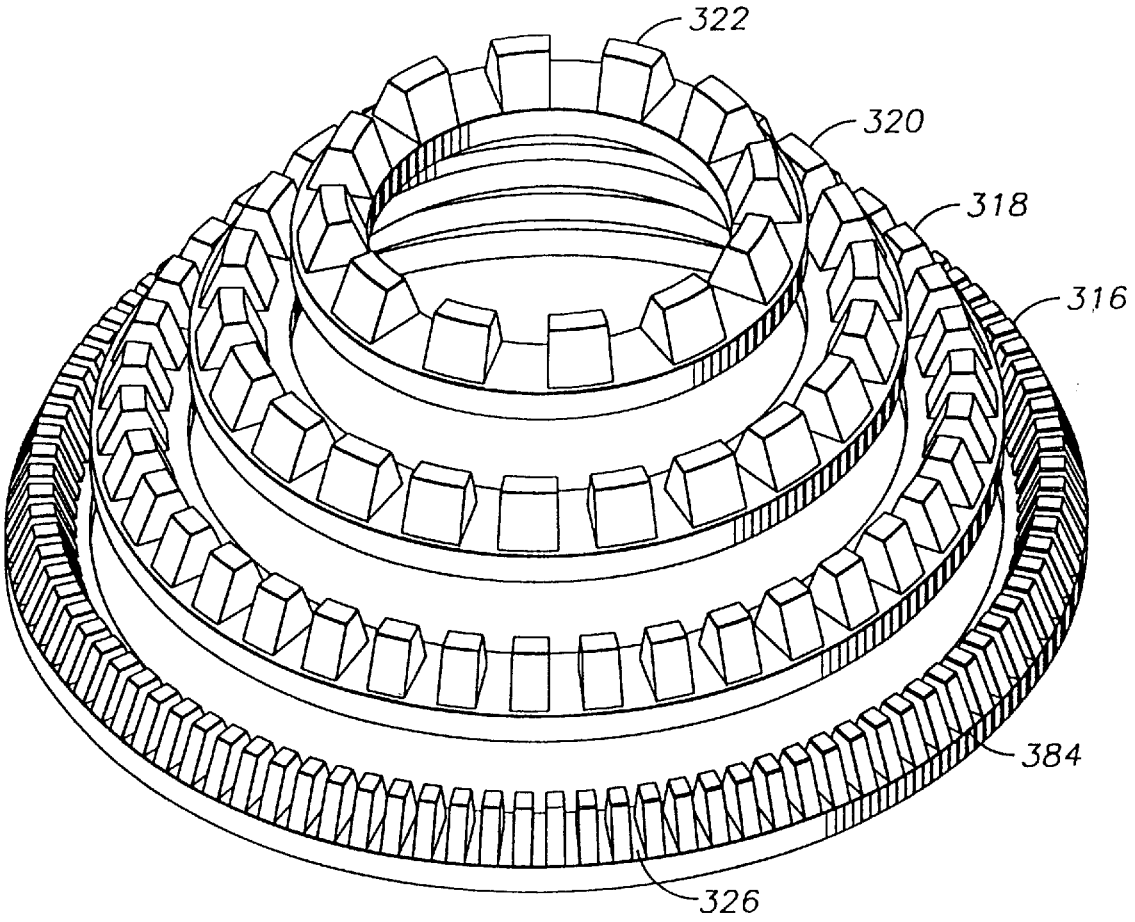
FIG. 17 is a perspective view of an alternate method of construction of a stator or a rotor.

FIG. 16 shows that the rotor 310 and stator 312 plates shown in FIGS. 14 and 15 may be formed from a number of identical pie or wedge shaped segment pieces 314. The pie shaped segment pieces 314 are typically investment cast and then machined to their final dimensions. The individual pie or wedge shaped segment pieces may then be bolted, welded or attached in a suitable manner to a bed plate 315. Alternatively, as shown in FIG. 17, the rotor 310 and stator 312 attrition plates may be formed by putting together a series of concentric rings or stages 316,318,320,322 which yield the same tooth pattern.

Figure 7:
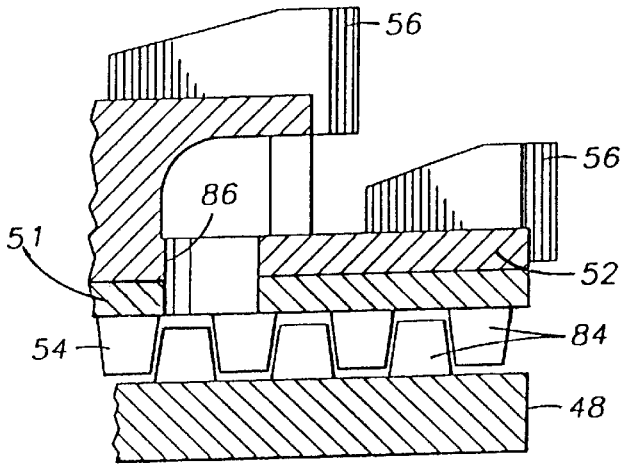
FIG. 7 is a side view, in partial section, showing the interdigitation of the shear blocks in the attrition zone.

The attrition zone shown in FIGS. 3 and 7 is formed by arranging interesting shear blocks or teeth 84 along radial lines which extend from the center of the rotor 52 and stator 48 attrition plates. In the embodiment shown in FIGS. 14 and 15, the shear blocks or teeth 384 on the rotor 310 plate intermesh with sheer blocks or teeth 384 on the stator 312 plate to form shear points 324 (FIG. 16) as each rotating tooth passes a stationary tooth. This arrangement of shear blocks or teeth 384 is effective in reducing the size of solid material, but some solid particles still bypass the shear points 324 and thus are allowed to pass through the attrition zone 360 FIG. 19) between the stator 312 plate and the rotor 310 plate unchanged or not at all reduced in size. Recirculation of some of the same solid material through the attrition zone 360 eventually reduces all particles to approximately the same size.

The attrition zone 360 FIG. 19 formed by the rotor 310 plate shown in FIG. 14 and the stator 312 plate shown in FIG. 15 differs from the design shown in FIG. 6 by varying the circumferential spacing 326 between the teeth or shear blocks 384 to control the size of the particles which are allowed to pass between the various stages of the attrition zone 360. The solid material to be reduced in size enters near the center 328 of the attrition zone 360 FIG. 15 and then passes radially outward until it exits at the outer perimeter 330 of the attrition zone 360. The shear blocks or teeth 384 on both the rotor 310 and stator 312 plates are arranged in rings or stages 316, 318, 320, 322 which intermesh with each other. This circumferential spacing between the individual shear blocks or teeth 384 in each successive stage of the attrition zone 360 is decreased as the radial distance from the center 328 of the attrition zone 360 increases so that a particular particle cannot pass to the next radial stage or ring without being reduced in size. Therefore, there is an inverse distance relationship between the spacing 326 between the teeth 384 and the distance of the tooth 384 from the center 328 of the attrition zone 360. It is only by reduction in size that particles are allowed to pass through the circumferential gap between the teeth. For example, the first stage is formed by four flow vanes 332 on the rotor retaining nut 334 (FIG. 14). These four flow vanes 332 cut the solid material to a coarse particle size. The spacing 326 between the teeth 384 in the second stage then, for example, cuts the material to a lesser particle size. The spacing 326 between the teeth 384 then incrementally decreases in all subsequent stages radially outward across the rotor 310 and stator 312 plates. This arrangement and array of shear blocks 384 provides for a multiple stage reduction of coarse material to fine material. Such multiple stage reduction of coarse material to fine material allows the unit to process a greater throughput of solid material while providing a predetermined particle size on a single pass through the attrition zone. The number of spaces 326 between teeth 384 increases with each successive stage so that increasingly more shears of solid material occur at each stage. In practice, this arrangement produces an average particle size which is even smaller than the spacing 326 between the shear blocks or teeth 384.

In the preferred embodiment, the teeth 384 on the stator 312 and rotor 310 plates are tapered from their base 336 to their top 338 FIG. 15) so that the gap 326 between the teeth 384 on the stator 312 plate and the gap 326 between the teeth 384 on the rotor 310 plate can be controlled. This means that the spacing 326 between the stator 312 plate and the rotor 310 plate can be varied to yield any particle size desired, even if the desired particle is coarser than the circumferential tooth spacing 326 in the outermost ring 316 (FIG. 17). Opening the gap 326 between the shear blocks or teeth 384 simply allows particles to bypass the remaining stages when they reach the size set by the gap 326. Conversely, closing the gap 326 allows for adjustment of the teeth 384, one with respect to other, due to wear of the teeth 384, to keep the dispersion and agitating performance at an optimum level. Optionally, the teeth 384 need not be tapered. If the teeth 384 are not tapered the sides of the teeth 384 are perpendicular to the bed plate 315. Thus such straight teeth 384 would intermesh with opposing teeth 384 but no means would be available for adjusting the gap 326 between the teeth 384 as is possible with tapered teeth 384. If cost is a concern it is less expensive to build rotor 310 and stator 312 plates with straight teeth 384 as opposed to tapered teeth 384. Finally, the symmetrical shape of the attrition zone 360 allows the rotor 310 plate to function in both directions of rotation. Thus, the rotor 310 and stator 312 plates last twice as long because the rotor 310 plate can be run in both clockwise and counterclockwise directions of rotation before the rotor 310 and stator 312 plates or any portion thereof need to be replaced.

It has also been found that the front face 340 (FIG. 15) of each tooth 384 on the rotor 310 plate imparts a velocity component to the fluid passing through the attrition zone 360 due to the centrifugal forces generated by the rotating teeth 384. In this respect the attrition zone 360 acts as a multi-stage centrifugal pump. Specifically, the stationary stages on the stator 312 plate tend to convert the fluid velocity to fluid pressure as the fluid impinges on the faces 340 of the stationary teeth 384 and travels radially outward on to the next stage. The faster the rotor plate 310 is turned, the greater the fluid flow and thus pressure generated. It will also be understood that as a tooth 384 passes in front of a gap 326 between the teeth 384 in a subsequent stage, the flow path for fluid is temporarily closed off. The continual rotation of the rotor 310 plate then temporarily opens up a fluid path. This fluid path is quickly closed as the next tooth 384 approaches the gap 326 between the teeth 384 in the subsequent stage. Thus the fluid flow is continually interrupted. This results in a pulsation component of fluid flow. This pulsation component of fluid flow serves to increase the flow of fluid through the attrition zone 360 and also enables self-cleaning of the rotor 310 and stator 312 plates.

It has also been found that the disclosed configuration of the attrition zone 360 with ever decreasing spaces 326 between the shear blocks or teeth 384 does an excellent job of mixing and homogenizing materials even if the liquid material contains no solids. Thus, the high energy shearing action of the fluid has applications in effectively homogenizing liquids, dispersing emmiscible powders in a liquid, and accelerating chemical reactions.

Figure 18:
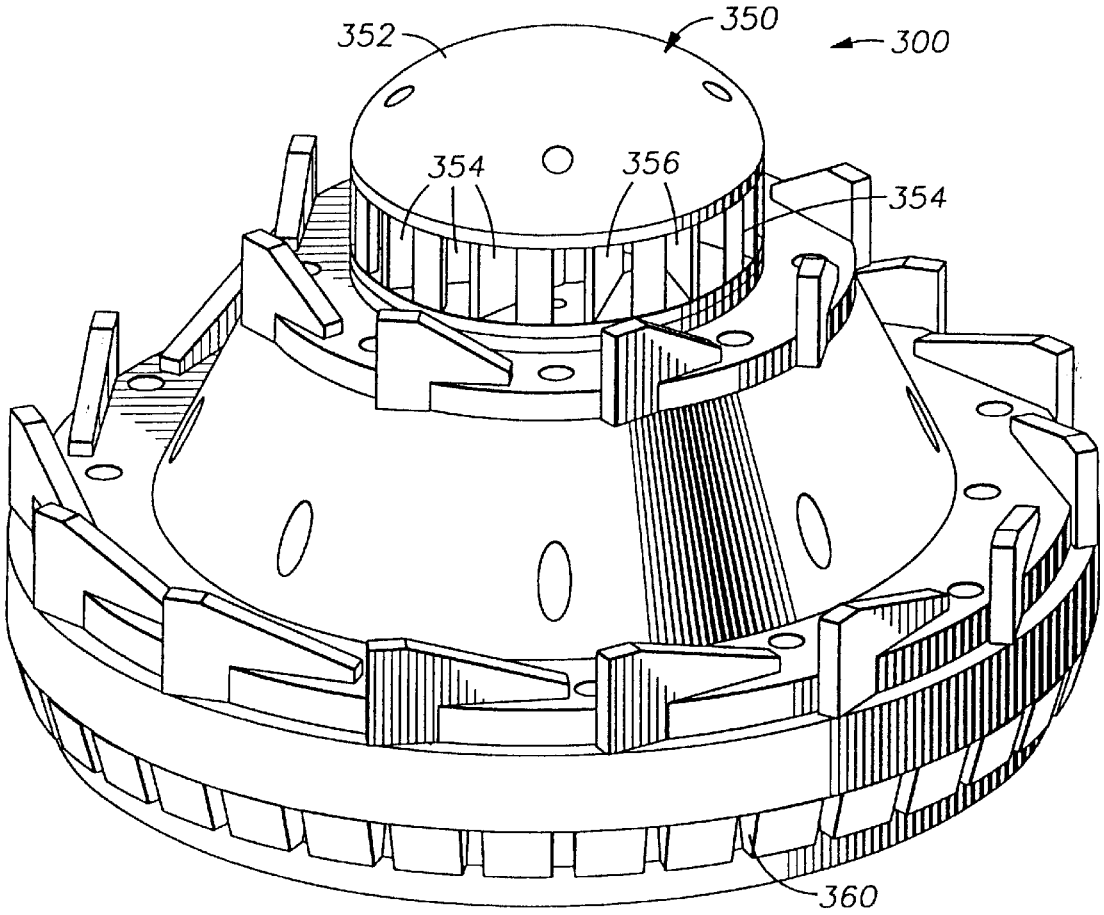
FIG. 18 is a perspective view of a dispersion and agitation system assembly.

The advantage attributed to using the dispersion and agitation system 300 of the present invention with ever decreasing spaces 326 between the teeth 384 lies in its ability to provide multi-stage mixing and grinding in a single work head. This ability to provide multistage mixing and grinding at a single work head increases the size reduction capability as well as the throughput of the work head. FIG. 18 illustrates a complete rotor assembly 350. As may be seen in FIG. 19 fluid flows into the top 352 of the rotor assembly 350 through entry ports 354 between intake vanes 356. The intake vanes 356 and entry ports 354 are best shown in FIG. 20. Fluid continues on through passageways 358 to the attrition zone 360 where it eventually exits and may be recycled back through the rotor assembly 350. One unique feature of the rotor assembly 350 design is the attrition zone intake vane or ring assembly 370. In this design the attrition zone 360 is located under the passageways 358. The intake vane or ring assembly 370 is equipped with individual vanes 356 which induce a fluid flow inside the rotor assembly 350 while simultaneously breaking down coarse solids by striking them. Fluid containing solids is drawn to the intake vanes 356 and routed to the attrition zone 360 at the bottom of the rotor assembly 350.

In the intake vane or ring assembly 370 design illustrated in FIG. 20 the intake ring 362 is raised higher on the rotor assembly 350. This allows the diameter of the intake vane or ring assembly 370 to be reduced so that it is actually less than the diameter of the attrition zone 360 intake holes 364. The centrifugal forces acting on the fluid entering the intake vanes or ring assembly 370 is much reduced because of this reduced diameter. Such reduction in diameter of the intake vane or ring assembly 370 has allowed the throughput of solid material and fluids through the rotor assembly 350 to increase. Also once solid material has passed through the intake vane or ring assembly 370, it passes down through passageways 358 in the center of the rotor assembly 350 and then passes radially outward to reach the attrition zone 360 intake holes 364. This flow path complies with the natural direction that the fluid would follow while inside a rotating rotor assembly. Optional placement of flow vanes 356 inside the rotor assembly 350 actually pressurizes the attrition zone 360 and induces the material to flow more aggressively through the attrition zone 360. Because of the effective pumping action of the instant attrition zone 360 design, these flow vanes 356 are not always necessary but are particularly suitable in some applications. The position of the individual intake vanes 356 in the intake vane or ring assembly 370 is such that each individual vane 356 faces opposite to the direction of rotation of the rotor 310 plate. The spacing between the individual vanes 356 tends to regulate the size of the particle that can be ingested through the intake vane or ring assembly 370. Therefore anything that can pass through the space between the individual vanes 356 can easily traverse the passage 358 inside the rotor assembly 350 without tending becoming stuck. The attrition zone 360 between the stator 312 and rotor 310 plates is only fed solids which have been sufficiently sized by the intake vane or ring assembly 370 on the top 352 of the rotor assembly 350. Since the individual intake vanes 356 face in a backward direction, only very small solids can change direction fast enough to be swept into the entry port 354 between the individual vanes 356 along with the fluid. Large solids are simply rejected because they just will not pass through the intake vane or ring assembly 370. Also the centrifugal forces created by the rotating rotor assembly 350 tend to propel large solids away from the intake vanes 356 so that this configuration generally will not become clogged.

Figure 21:
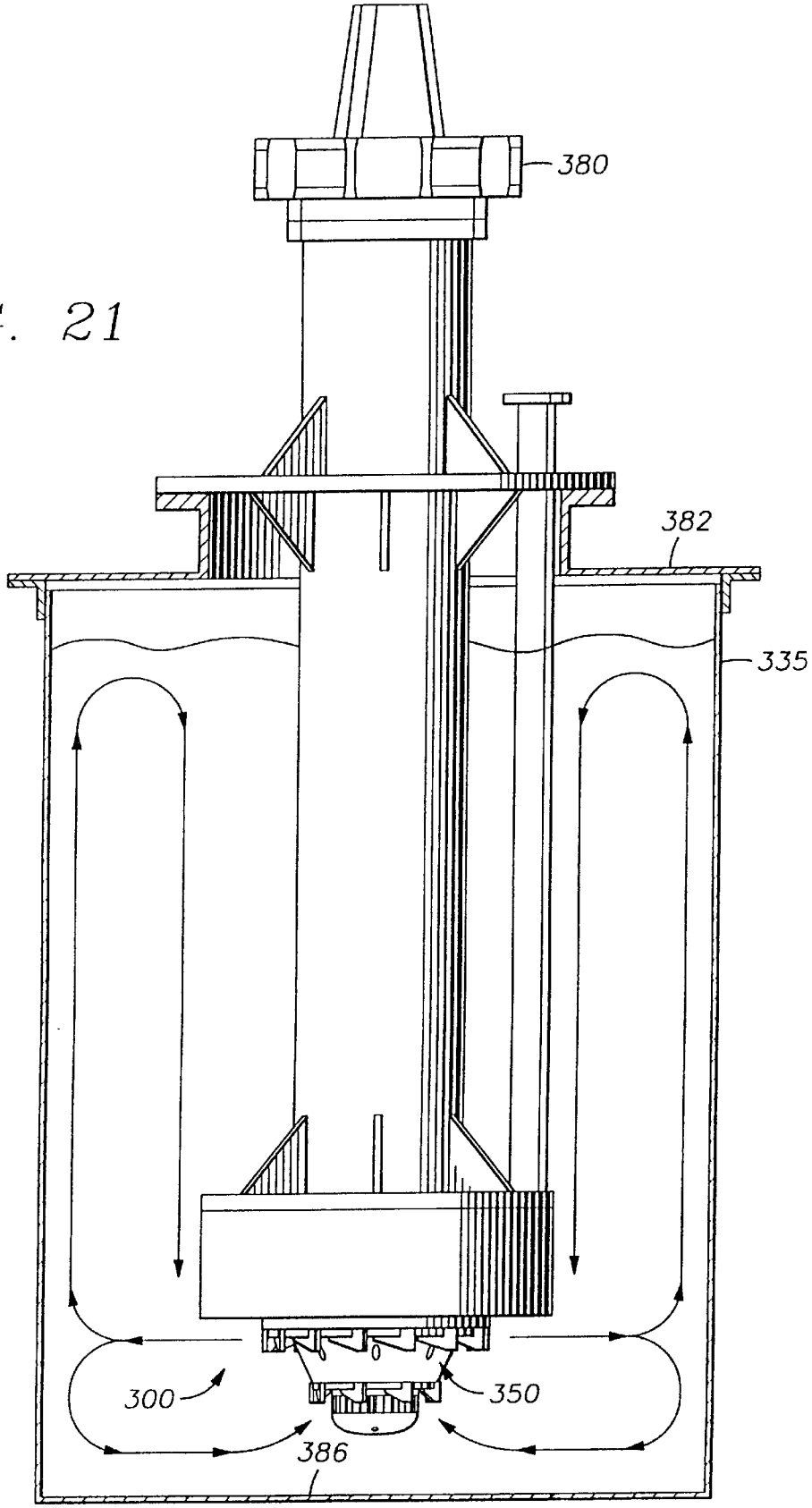
FIG. 21 is a internal view of tank wherein the dispersion and agitation system has been installed through the top of the tank.
Figure 24:
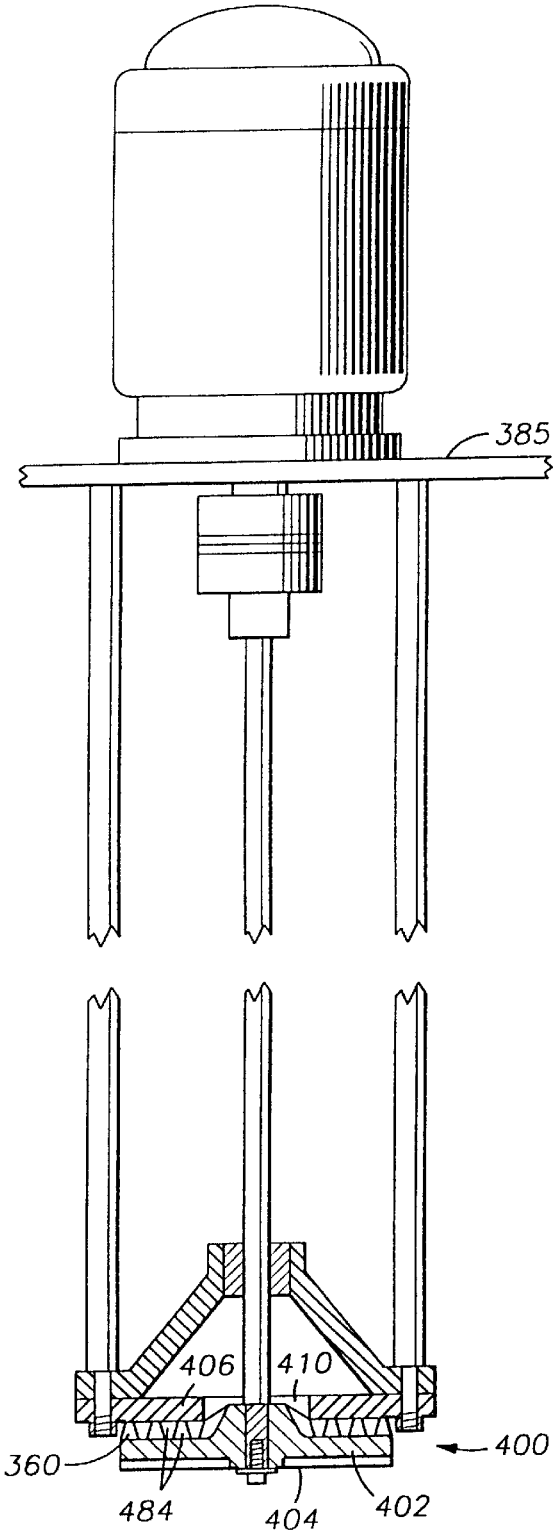
FIG. 24 is an elevational view of a reduced size dispersion and agitation system with an upwardly facing opening but without the vane entry system.
Figure 25:
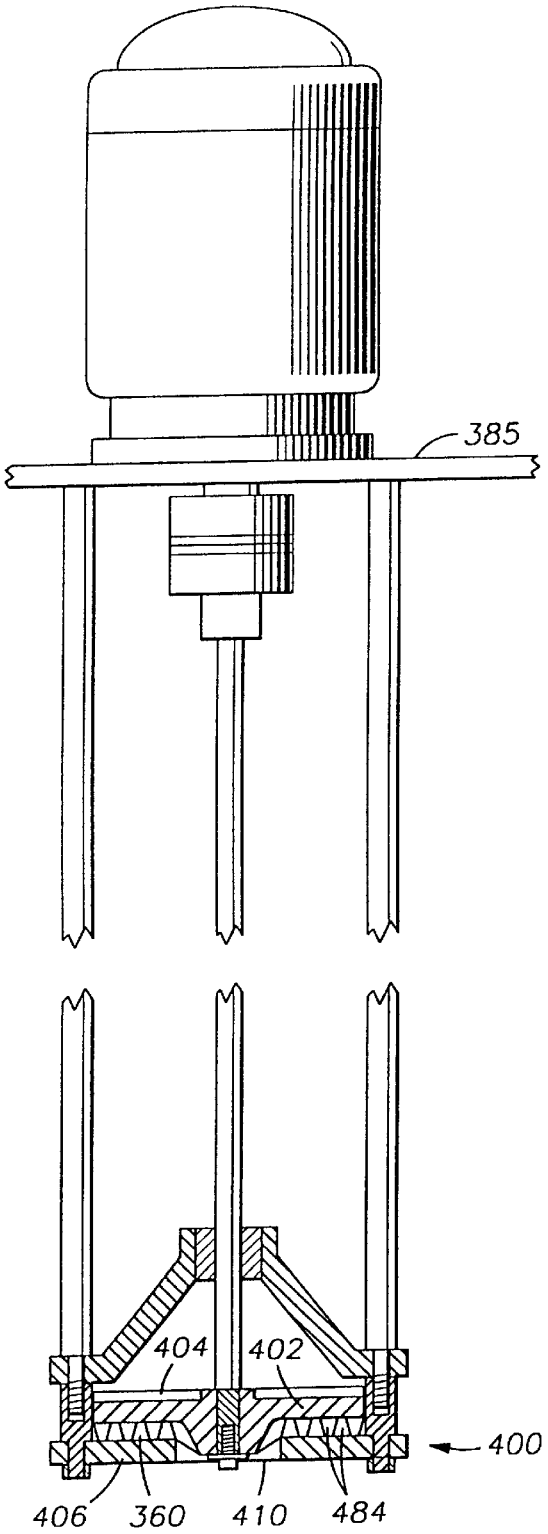
FIG. 25 is an elevational view of a reduced size dispersion and agitation system with a downwardly facing opening but without the vane entry system.

Now that the dispersion and agitation system 300 of the present invention has been described with regard to the internal configuration of its working parts it will be understood by those of ordinary skill in the art that it may be configured in a number of ways. Specifically, the dispersion and agitation system 300 may be driven by a connection to a source of rotational power 380 from the top side 382 of a tank 385 instead of the bottom side 386 of a tank 385. This is shown in FIG. 21. Herein the same rotor 350, assembly and attrition zone are used. As shown in FIG. 22, the embodiment shown in FIG. 21 includes a collection ring 390 surrounding the attrition zone 360. The top mounting of the dispersion and agitation system 300 reduces the overall cost and makes it possible to adapt a dispersion and agitation system 300 to an existing tank. The design also allows for the adjustment of the attrition zone 360 gap and continuous extraction of process material from the tank.

In FIG. 23 the dispersion and agitation system 300 of the present invention is shown mounted in the side 388 or bottom 386 of an existing tank. Note that the features of this embodiment are essentially the same as the unit shown in FIG. 22. Because of the mounting versatility of tile system shown in FIG. 23, it can be used as a substitute for conventional agitators. It also has the added ability of not only mixing the contents within the tank but also to disbursing any solids which may be in the tank.

Figure 26:
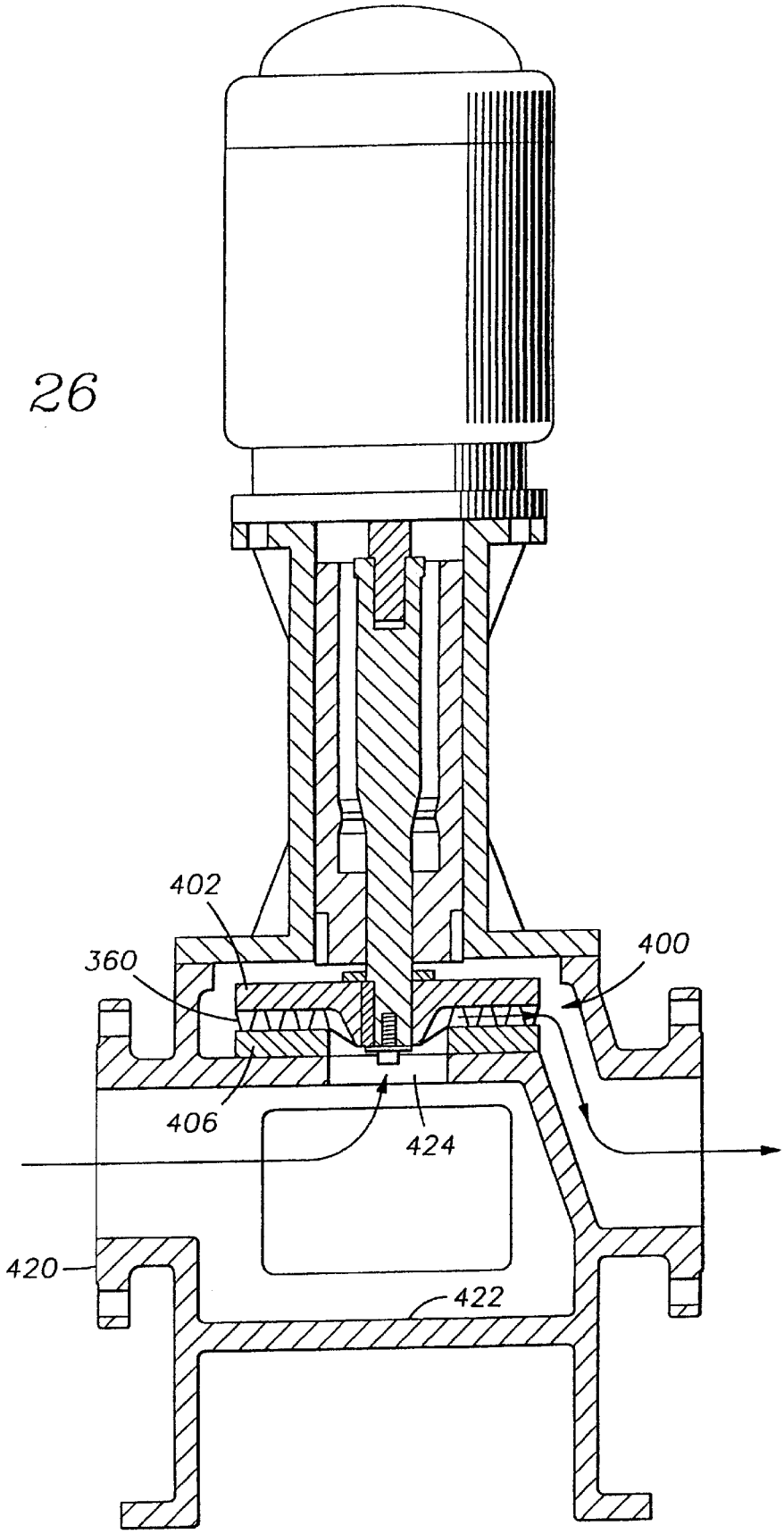
FIG. 26 is a cross sectional view of the dispersion and agitation system installed fed in a pipeline.

A still smaller version of the dispersion and agitation system 400 is shown in FIG. 26. Therein the dispersion and agitation system 400 is mounted directly into a pipe line 420 conveying liquids and/or liquids and solid material. The dispersant and agitation system 400 is oriented vertically so that flow must pass upwardly from the pipe line 420 to reach the attrition zone 360. This vertical orientation provides the opportunity to position a junk collection chamber 422 directly beneath the attrition zone intake 424. Such an arrangement allows heavy objects such as nuts, bolts, rocks and the like to drop from the flow stream before they enter the attrition zone 360. In one embodiment, a magnet can even be positioned in the junk chamber to attract and hold ferrous material. Junk then can easily be removed from the collection chamber through a removable access cover. This pipe line mounted unit features single piece rotor 402 and stator 406 plates as well as a single piece cast housing.

Conventional pipeline mounted equipment provides a single-stage reduction of solids. If the solids in the stream are large, then the single-stage must provide a coarse grind to yield the desired throughput. Subsequent finer stages can only be used on streams that contain small solids. A fine-stage used with coarse solids actually results in plugging of the work-head because it cannot reduce the size of the solids fast enough to pass through the fine openings in the stator plate, thus resulting in reduction of the flow through the unit. The attrition mill of the present invention, with ever decreasing spaces between the teeth, overcomes these drawbacks because it can accept coarse solids at a high flow rate and then reduce them to a fine particle size through the use of multiple stages on a single rotor plate.

Because many varying and different embodiments may be made within the scope of the inventive concept herein taught, and because many modification may be made in the embodiments herein detailed in accordance with the descriptive requirement of the law, it is to be understood that the details herein are to be interpreted as illustrative and not in any limiting sense.

What is claimed is:

1. An apparatus for dispersing solids in a liquid comprising:

a) a containment;

b) a variable displacement particle grinding means removably attached to said containment for selectively reducing particle size of said solids in said liquid comprising:

i) a multi-shear rotary grinder, having a stationary, and a rotating, attrition plate having a linearly, adjustable rotor member, thereby defining a variable attrition zone, mesial said stationary and rotating attrition plates, and a plurality of descending grinding stages, ii) an impeller vane means, attached to said rotor member, for agitating said liquid in said containment and breaking said solids prior to said liquid entering said attrition zone;

iii) intake means attached to said rotor member for importing said liquid and solids by suction into said attrition zone;

iv) an intermediate member mesial said intake means and said attrition zone, said member having internal ports in communication with said intake vane means and said attrition zone, and v) a drive means connected to said rotary member for turning said rotating attrition plate.

2. An apparatus for dispersing solids in a liquid according to claim 1 wherein said linearly, adjustable rotor member further comprises a sliding quill assembly comprising a mechanical seal and bearing means for minimizing shaft length and run-out.

3. An apparatus for dispersing solids in a liquid according to claim 1 where in grinding means further comprises an accumulation ring surrounding said stationary and rotating attrition plates.

4. An apparatus for dispersing solids in a liquid according to claim 1 where in grinding means further comprises a means for incrementally varying said displacement between said stationary and rotating attrition plates.

5. An apparatus for dispersing solids in a liquid according to claim 4 wherein said shear blocks are integral with a substrate mountable to said stationary and rotating plates.

6. An apparatus for dispersing solids in a liquid according to claim 5 wherein said segments are rings.

7. An apparatus for dispersing solid materials entrained in a liquid according to claim 6 wherein said rotating attrition plate further comprises vanes located on a face opposite said shear blocks.

8. An apparatus for dispersing solid materials entrained in a liquid according to claim 6 wherein said rotating attrition plate further comprises flow vanes disposed central to said shear blocks.

9. An apparatus for dispersing solid materials entrained in a liquid according to claim 6 wherein said multi-shear rotary grinder further comprises a variable displacement attrition zone.

10. An apparatus for dispersing solids in a liquid according to claim 1 wherein said attrition zone is comprised of:

a) a plurality of shear blocks, attached to a face of said stationary attrition plate, arranged in concentric circles;

b) a plurality of shear blocks, attached to a face of said rotating attrition plate, arranged in concentric circles and located in a manner whereby said shear blocks attached to said stationary and rotating attrition plates mesh; and c) a plurality of progressive reduction stages, defined by said shear blocks, extending outwardly from said rotor member.

11. An apparatus for dispersing solids in a liquid according to claim 10 wherein said shear block and substrate is divided into segments.

12. An apparatus for dispersing solid materials entrained in a liquid comprising:

a) a multi-shear rotary grinder comprising:

I) stationary attrition plate and a rotating attrition plate having opposing faces, each said opposing face having a plurality of shear blocks, said shear blocks on each said face arranged to mesh with its opposing shear block thereby defining an attrition zone having a plurality of progressive descending grinding stages; and II) a bearing housing attached to said stationary attrition plate;

b) a drive shaft connected to said rotating attrition plate via said bearing housing;

c) a drive having a flange member attached thereto, connected to said drive shaft;

d) a means for securing said bearing housing to said drive flange member; and e) a means for exchanging positions of said stationary and rotating plates.

13. A method for dispersing solid materials entrained in a liquid comprising the steps of:

a) adapting a multi-shear rotary grinder to a body having inlet, outlet and a junk chamber said rotary grinder comprising:

I) stationary attrition plate and a rotating attrition plate having opposing faces, each said opposing face having a plurality of shear blocks, said shear blocks on each said face arranged to mesh with its opposing shear block thereby defining an attrition zone having a plurality of progressive descending grinding stages;

II) a drive shaft connected to said rotating attrition plate via a bearing housing;

III) a drive having a flange member attached thereto, connected to said drive shaft and said bearing housing; and IV) a means for securing said bearing housing to said drive flange member;

b) attaching said multi-shear rotary grinder to said body in a manner whereby said grinder is perpendicular to said inlet and outlet and said solid materials entrained in a liquid passing through said junk chamber are forced through said attrition zone reducing said solids to a variably selective particle size before exiting said outlet.

14. A method for dispersing solid materials entrained in a liquid according to claim 13 wherein said method further includes the step of varying the displacement of said attrition zone in a manner whereby solids are variably reduced in a single attrition zone.

15. An apparatus for dispersing solid materials entrained in a liquid comprising:

a) a housing having an inlet and outlet;

b) a grinding means located within said housing comprising;

I) a stationary attrition plate and a rotating attrition plate having opposing faces, each said opposing face having a plurality of shear blocks, said shear blocks on each said face arranged to mesh with its opposing shear block said stationary attrition plate and a rotating attrition plate defining a single attrition zone, having a plurality of progressive descending grinding stages;

II) a drive shaft attached at one end to said rotating attrition plate the opposite end extending externally of said housing for coupling to a longitudinally stationary drive means; and III) a means for incrementally varying volumetric displacement of said attrition zone.

16. An apparatus for dispersing solids in a liquid according to claim 15 wherein said means for incrementally varying volumetric displacement is a linearly, adjustable rotor shaft member further comprising a sliding quill assembly comprising a mechanical seal and bearing means for minimizing shaft length and run-out.

17. A apparatus according to claim 15 wherein said shear blocks are arranged in concentric circles, having progressive numbers of said shear blocks in each circle, beginning near the center of said attrition plate, said shear blocks being capable of shearing solids including metal into a specified particle size.

18. A apparatus according to claim 17 wherein said shear blocks are integral with a substrate mountable to said stationary and rotating plates.

19. An apparatus for dispersing solids in a liquid according to claim 18 wherein said shear blocks and substrate is divided into segments.

20. An apparatus for dispersing solids in a liquid according to claim 19 wherein said segments are rings.

21. An apparatus for dispersing solids in a liquid according to claim 18 wherein said attrition plates further comprises flow vanes disposed central to said shear blocks.

* * * * *